US008422902B2

(12) United States Patent
Sato

(10) Patent No.: US 8,422,902 B2
(45) Date of Patent: Apr. 16, 2013

(54) IMAGE FORMING APPARATUS THAT USES FIXING MEMBER TEMPERATURE OR THICKNESS OF RECORDING MEDIUM TO DETECT WHEN TO HALT THE ROTATION DRIVE OF A FIXING MEMBER DRIVE UNIT

(75) Inventor: Toshiki Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 661 days.

(21) Appl. No.: 12/323,659

(22) Filed: Nov. 26, 2008

(65) Prior Publication Data

US 2009/0136245 A1 May 28, 2009

(30) Foreign Application Priority Data

Nov. 27, 2007 (JP) ..... 2007-305457

(51) Int. Cl.
*G03G 15/20* (2006.01)
*G03G 15/00* (2006.01)

(52) U.S. Cl.
USPC ..... 399/69; 399/33; 399/44; 399/45; 399/67

(58) Field of Classification Search ..... 399/67
See application file for complete search history.

(56) References Cited

U.S. PATENT DOCUMENTS 6,151,462 A * 11/2000 Fukuzawa et al. ..... 399/67
6,175,699 B1 * 1/2001 Kato et al. ..... 399/69
6,567,624 B1 * 5/2003 Murata ..... 399/69
2007/0134018 A1 * 6/2007 Nanba et al. ..... 399/69
2007/0292154 A1 * 12/2007 Ishikuro et al. ..... 399/67

FOREIGN PATENT DOCUMENTS

JP 2001-242741 A 9/2001

OTHER PUBLICATIONS

JP2007-305457—JPO Notification of Reasons for Refusal dated Oct. 6, 2009.*
JP2007-305457—JPO Notification of Reasons for Refusal dated Feb. 23, 2010.*
JP2007-305457—JPO Notification of Reasons for Refusal dated Jun. 29, 2010.*

* cited by examiner

*Primary Examiner* — Walter L Lindsay, Jr.
*Assistant Examiner* — David Bolduc
(74) *Attorney, Agent, or Firm* — Panitch Schwarze Belisario & Nadel LLP

(57) ABSTRACT

An image forming apparatus forming an image by fixing a developer on a recording medium with heat includes a fixing member, a pressure member, a drive unit, a heat unit, a temperature detection unit, a control unit, and a temperature record storing unit. The fixing member is rotatably supported and heats the recording medium. The pressure member presses against the fixing member. The drive unit rotationally drives the fixing member. The heat unit heats the fixing member. The temperature detection unit detects temperature of the fixing member. The control unit controls the heat unit and the drive unit. The temperature record storing unit stores a temperature record of the temperature detection unit. The control unit controls, based on the temperature record of the temperature record storing unit, a rotation drive of the drive unit in a case of non-fixing.

10 Claims, 15 Drawing Sheets

| THICKNESS OF RECORDING MEDIUM IN TRAY (REAM WEIGHT) | HALT-WAIT TIME t_roll |
|---|---|
| THIN SHEET (BELOW 55KG) | 5SEC |
| NORMAL (BETWEEN 55 AND 70KG) | 10SEC |
| THICK SHEET (BETWEEN 70 AND 100KG) | 20SEC |

IMAGE FORMING APPARATUS THAT USES FIXING MEMBER TEMPERATURE OR THICKNESS OF RECORDING MEDIUM TO DETECT WHEN TO HALT THE ROTATION DRIVE OF A FIXING MEMBER DRIVE UNIT

BACKGROUND OF THE INVENTION

1. Field of the Invention

The present invention relates to an image forming apparatus employing a fixing device.

2. Description of Related Art

An electrophotographic printer generally transfers toner corresponding to a print image to a sheet of paper and fixes the toner onto the sheet of paper with application of heat and pressure by a fixing roller and a pressure roller. In the course of a print process, heat of the fixing roller is removed from a surface thereof by a recording medium or the pressure roller. On the other hand, when passage of the recording medium is finished (i.e., the print process is finished), the heat is not removed, causing a rapid increase in surface temperature by emergence of the heat accumulated inside the fixing roller. Such a phenomenon is hereafter referred to as an overshoot. An excess increase in the surface temperature of the fixing roller causes poor fixing quality or damages of a fixing device. Japanese Un-examined Patent Application Publication No. 2001-242741 discloses a method for reducing such an excess increase in the temperature of the fixing roller by rotating the fixing roller for a certain time period while turning off drive of a heater after the print process is finished and passage of the recording medium in the fixing device is completed so as to reduce the overshoot.

In a case where a large number of thick recording media are fixed, however, such a related-art method for reducing the excess increase in temperature by rotation of the fixing roller for the certain time period needs an adequate amount of time to rotate the fixing roller in the post-print process due to an increase of an accumulated heat amount inside of the fixing roller. Consequently, in a case where the rotation of the fixing roller is controlled with respect to each post-print process, there causes a problem of prolongation of a waiting time period until the subsequent print process begins.

It is an object of the present invention to provide an image forming apparatus capable of reducing the overshoot after a rotation of a fixing roller halts while controlling to shorten a rotation time period of the fixing roller, and capable of shortening a time period until the subsequent print process.

BRIEF SUMMARY OF THE INVENTION

According to one aspect of the invention, an image forming apparatus forming an image by fixing a developer on a recording medium with heat, the image forming apparatus includes: a fixing member, disposed rotatably supported, heating the recording medium; a pressure member pressing against the fixing member; a drive unit rotationally driving the fixing member; a heat unit heating the fixing member; a temperature detection unit detecting temperature of the fixing member; a control unit controlling the heat unit and drive unit; and a temperature record storing unit storing a temperature record of the temperature detection unit. The control unit controls, based on the temperature record of the temperature record storing unit, a rotation drive of the drive unit in a case of non-fixing.

According to another aspect of the present invention, an image forming apparatus forming an image by fixing a developer on a recording medium with heat, the image forming apparatus includes: a fixing member, disposed rotatably supported, heating the recording medium; a pressure member pressing against the fixing member; a drive unit rotationally driving the fixing member; a heat unit heating the fixing member; a temperature detection unit detecting temperature of the fixing member; a medium class decision unit determining a class of the recording medium to be fixed; and a control unit controlling the heat member and the drive unit. The control unit halts the rotation drive of the drive unit based on the class of the recording medium determined by the medium class decision unit in a case of non-fixing.

Additional features and advantages of the present invention will be more fully apparent from the following detailed description of embodiments, the accompanying drawings and the associated claims.

BRIEF DESCRIPTION OF THE DRAWINGS

A more complete appreciation of the aspects of the invention and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
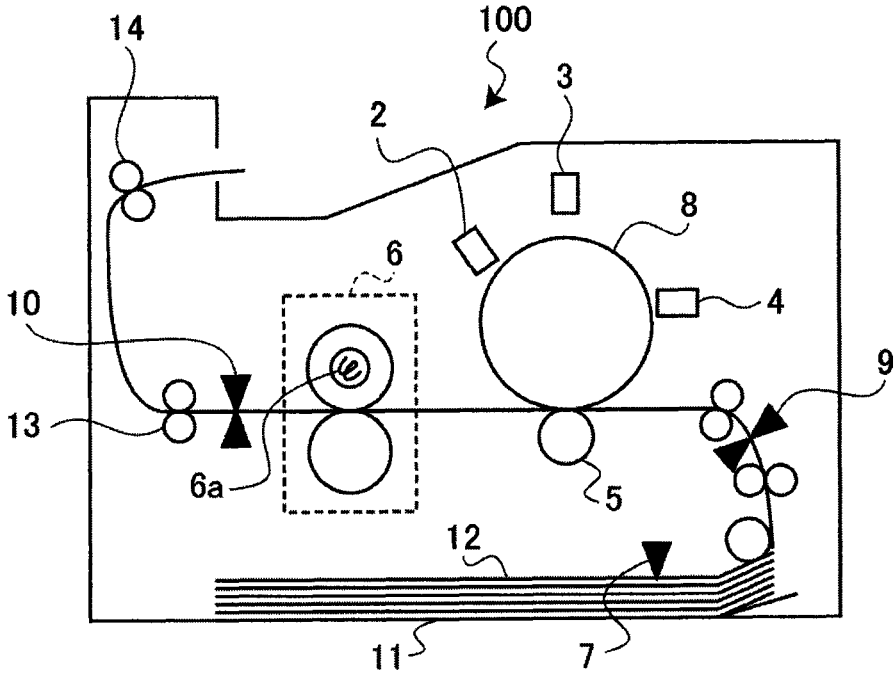
FIG. 1 is a schematic diagram illustrating an image forming apparatus according to a first embodiment of the present invention.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Reference is now made to the drawings, wherein like reference numerals designate identical or corresponding parts throughout the several views.

First Embodiment

Referring to FIG. 1, an image forming apparatus 100 according to the present invention is illustrated. The image forming apparatus 100 includes a charging device 2, a light emitting diode (LED) head 3, a development device 4, a transfer device 5, a fixing device 6, a remaining sheet amount sensor 7, a photosensitive drum 8, a writing sensor 9, an ejection sensor 10, a sheet cassette 11, and ejection rollers 13 and 14.

Figure 2:
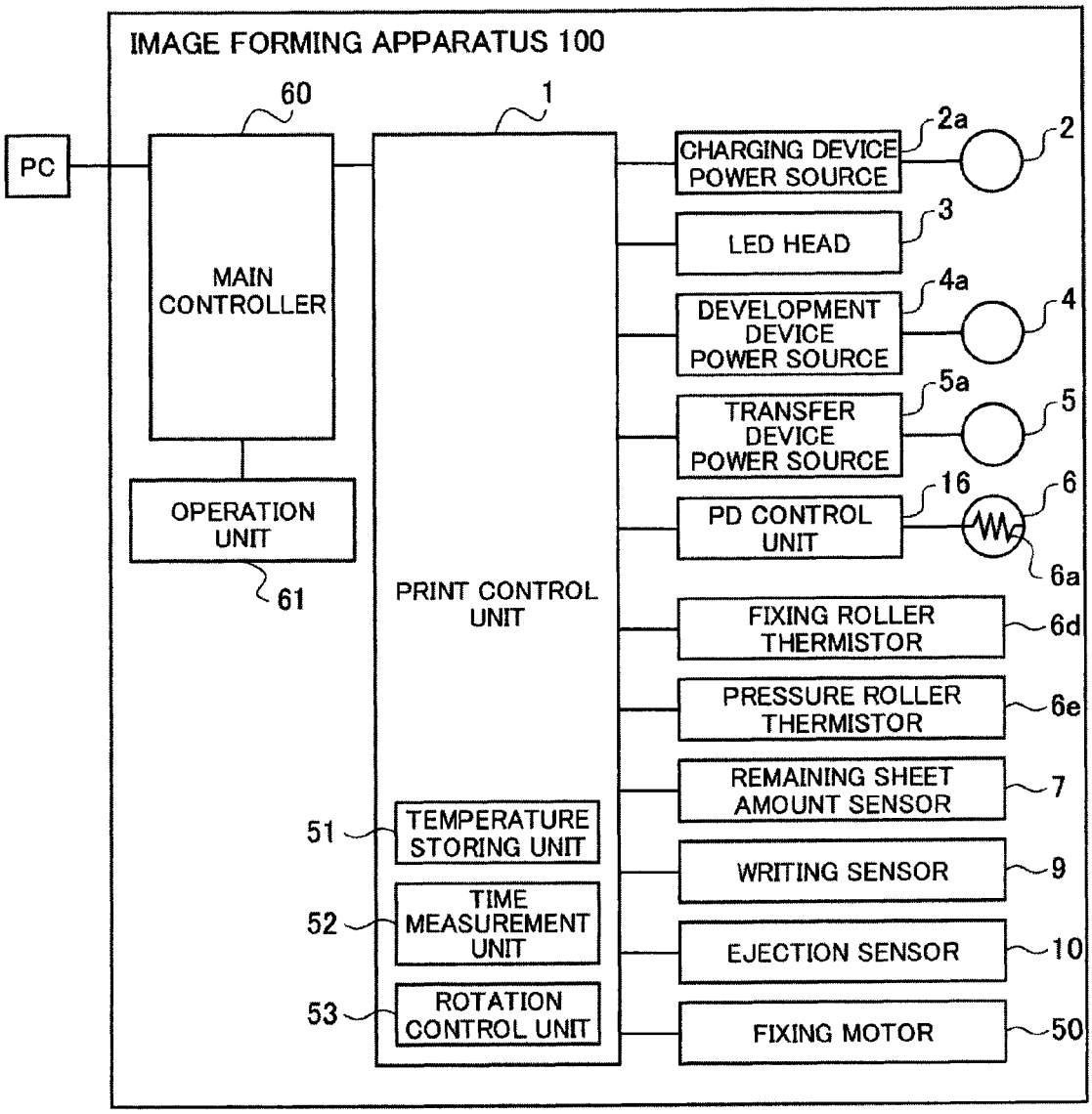
FIG. 2 is a block diagram illustrating print control of the image forming apparatus of FIG. 1.

Referring to FIG. 2, the image forming apparatus 100 is illustrated in a block diagram. The image forming apparatus 100 includes a print control unit 1 that includes a microprocessor, a read only memory (ROM), an electronically erasable and programmable read only memory (EEPROM), a random access memory (RAM), an input/output port, and a timer. The print control unit 1 is connected with an external information process apparatus such as a personal computer (PC) or an operation unit 61 (described later), and executes a print process by receiving a control signal and image data rasterized for printing transmitted from a main controller 60 that controls the image forming apparatus 100 as a whole. The print control unit 1 includes a temperature storing unit 51 storing information relating to temperature of a certain time period, a time measurement unit 52 measuring a prescribed time period, and a rotation control unit 53 controlling a rotation of a fixing motor 50.

The print control unit 1 is connected with a charging device power source 2*a*, the LED head 3, a development device power source 4*a*, a transfer device power source 5*a*, a power distribution control unit 16, a fixing roller thermistor 6*d* serving as a temperature detection unit, a pressure roller thermistor 6*e* serving as a second temperature detection unit, the remaining sheet amount sensor 7, the writing sensor 9, the ejection sensor 10, and the fixing motor 50 serving as a drive unit.

The charging device 2 is connected with the charging device power source 2*a*, and is applied with prescribed voltage from the charging device power source 2*a* based on a command from the print control unit 1, thereby generating high voltage to charge a surface of the photosensitive drum 8 with −600V, for example. The charging device 2 is, for example, a semiconductive charging roller rotating while contacting the surface of the photosensitive drum 8, and generates a voltage between −1000 V and −1100 V, for example.

The LED head 3 only exposes a region in which an image is formed with respect to the surface of the photosensitive drum 8, so that an electrostatic latent image is formed on the surface of the photosensitive drum 8, for example, with the voltage between −50 V and 0 V. According to the first embodiment of the present invention, the LED head 3 is employed, but is not limited thereto. Alternatively, another exposure device, for example, a laser irradiator, may be employed.

The development device 4 is connected with the development device power source 4*a*, charges toner with negative voltage, and supplies the negatively charged toner to the electrostatic latent image on the surface of the photosensitive drum 8 using electrical attraction force, thereby forming a toner image on the surface of photosensitive drum 8.

The transfer device 5 is connected with the transfer device power source 5*a* and transfers the toner image formed on the surface of the photosensitive drum 8 to a recording medium using the electrical attraction force.

The sheet cassette 11 stores a recording medium 12 on which an image is not yet formed, that is, before formation of the image. The remaining sheet amount sensor 7 monitors a remaining amount of the recording medium 12 stored in the sheet cassette 11, and transmits a signal relating to the presence or absence of the recording media 12 to the print control unit 1. For example, upon detecting the recording medium 12, the remaining sheet amount sensor 7 transmits a detection signal to the print control unit 1. The writing sensor 9 monitors a passage of the recording medium 12 on which the image is to be formed. Upon detecting the recording medium 12, the writing sensor 9 transmits a detection signal to the print control unit 1. The ejection sensor 10 monitors a sheet feeding position of the recording medium 12. Upon detecting the recording medium 12, the ejection sensor 10 transmits a detection signal to the print control unit 1. The ejection rollers 13 and 14 eject the recording medium 12 having thereon the toner image fixed by the fixing device 6 to an outside the image forming apparatus 100.

Figure 3:
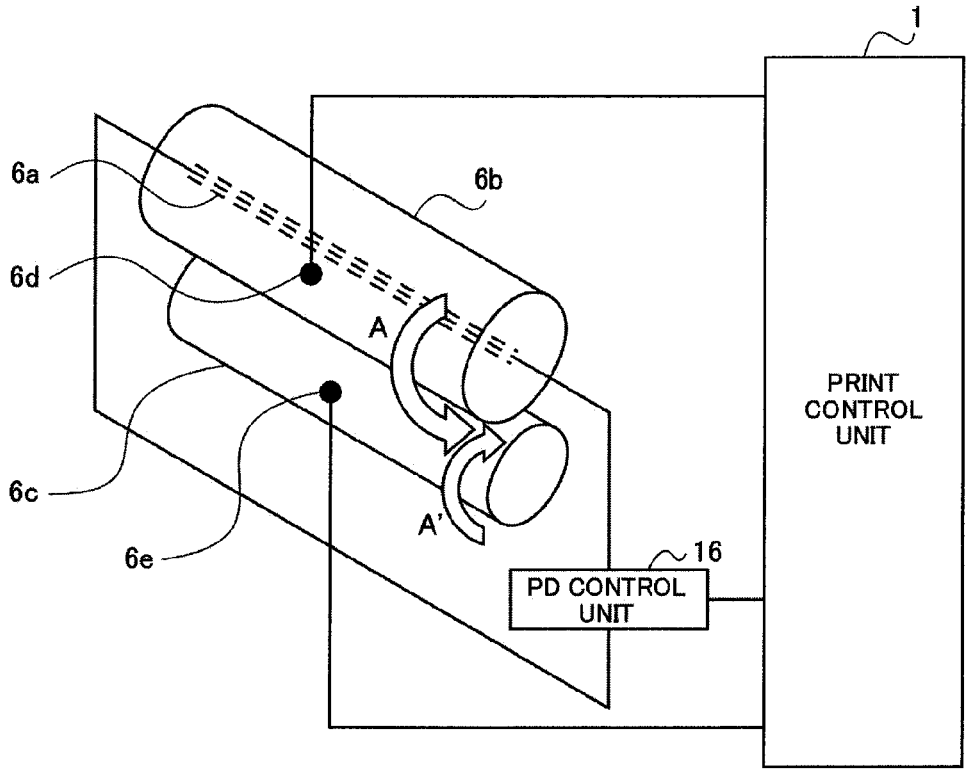
FIG. 3 is a schematic diagram illustrating a fixing device included in the image forming apparatus of FIG. 1.

Referring to FIG. 3, the fixing device 6 included in the image forming apparatus 100 is illustrated. The fixing device 6 includes a halogen lamp 6*a* serving as a heat unit, a fixing roller 6*b* serving as a fixing member, a pressure roller 6*c* serving as a pressure member, the fixing roller thermistor 6*d*, and the pressure roller thermistor 6*e*. The halogen lamp 6*a* is disposed inside the fixing roller 6*b* and is connected with the power distribution control unit 16. The halogen lamp 6*a* generates heat in response to the voltage applied from the power distribution control unit 16, and the generated heat is uniformly transmitted to the fixing roller 6*b* as a whole from the halogen lamp 6*a*. According to the first embodiment of the present invention, the halogen lamp 6*a* is employed as a heat method of the fixing roller 6*b*, but is not limited thereto. Alternatively, another method, for example, a heat method using a ceramic heater, may be employed.

The fixing roller 6*b* rotates, for example, in a direction indicated by an arrow A shown in FIG. 3 by the fixing motor 50. The pressure roller 6*c* contacts the fixing roller 6*b* and is disposed in such a manner that a direction of a rotation axis of the pressure roller 6*c* and a direction of a rotation axis of the fixing roller 6*b* are congruent with each other. The pressure roller 6*c* is tuned to rotation operation of the fixing roller 6*b* by a linkage mechanism (not shown), and rotates, for example, in a direction indicated by an arrow A' shown in FIG. 3. In other words, the pressure roller 6*c* rotates in an opposite direction relative to the rotation direction of the fixing roller 6*b*. According to the first embodiment of the present invention, the fixing motor 50 is employed as a method to rotate the fixing roller 6*b*. Alternatively, the fixing motor 50 may be employed as a method to rotate the pressure roller 6*c*.

The fixing roller 6*b* and the pressure roller 6*c* apply heat and pressure to a not yet fixed toner image carried on the recording medium 12, so that the toner image is adhered and fixed on the recording medium 12. By the above-described rotation operation of fixing roller 6*b* and the pressure roller 6*c*, the recording medium 12 is conveyed to the ejection rollers 13 and 14 and is subsequently conveyed to the outside the image forming apparatus 100.

The fixing roller thermistor 6*d* detects surface temperature of the fixing roller 6*b* and is disposed with respect to the fixing roller 6*b* in a contact or non-contact manner. The pressure roller thermistor 6*e* detects surface temperature of the pressure roller 6*c* and is disposed with respect to the pressure roller 6*c* in a contact or non-contact manner. Each of the fixing roller thermistor 6*d* and the pressure roller thermistor 6*e* has a property of varying a resistance value thereof according to the temperature, and the print control unit 1 detects such a variation of the resistance value to detect the surface temperature of each of the rollers.

The power distribution unit 16 switches a power distribution state of the halogen lamp 6*a* based on a command from the print control unit 1. In other words, the power distribution control unit 16 switches on and off the power distribution to the halogen lamp 6*a* in such a manner that the surface temperature of the fixing roller 6*b* detected by the fixing roller thermistor 6*d* is within a prescribed temperature range, for example, one hundred seventy (170) degrees Celsius with plus or minus ten (10) degrees Celsius, during the print operation. For example, where the surface temperature of the fixing roller 6*b* detected by the fixing roller thermistor 6*d* is higher than the temperature range centering on one hundred seventy (170) degrees Celsius, the power distribution control unit 16 switches off the power distribution to the halogen lamp 6*a* upon receiving the command from the print control unit 1 to switch off the power distribution to the halogen lamp 6*a*. On the other hand, where the surface temperature of the fixing roller 6*b* detected by the fixing roller thermistor 6*d* is lower than, for example, the temperature range centering on one hundred seventy (170) degrees Celsius, the power distribution control unit 16 switches on the power distribution to the halogen lamp 6*a* upon receiving the command from the print control unit 1 to switch on the power distribution to the halogen lamp 6*a*.

The temperature storing unit 51 serving as a storage region stores the surface temperature of the fixing roller 6*b*. The surface temperature of the fixing roller 6*b* is repeatedly measured per unit time. The time measurement unit 52 measures a time using, for example, one hundred (100) milliseconds (ms) as a unit time. The rotation control unit 53 controls the rotation of the fixing motor 50.

Figure 4:
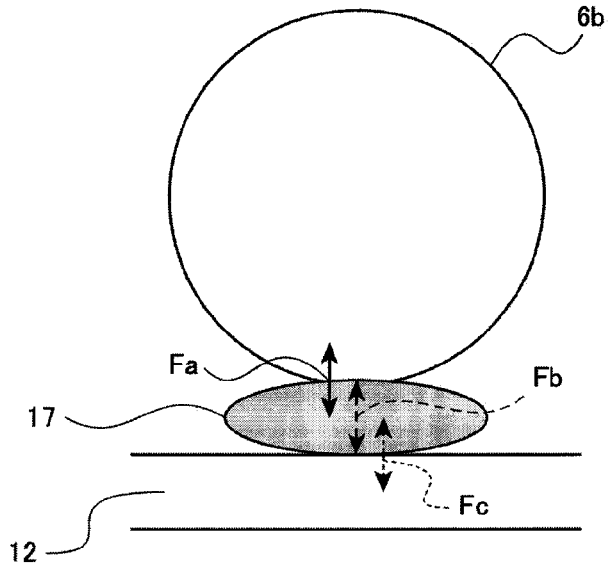
FIG. 4 is a diagram illustrating adhesion of toner by melting using the fixing device.

Referring to FIG. 4, adhesion of the toner image on the recording medium 12 is illustrated. The fixing device 6 melts and adheres toner 17 on the recording medium 12. In FIG. 4, a reference numeral Fa represents adhesion force between the toner 17 and the fixing roller 6*b*, a reference numeral Fb represents cohesion force of the toner 17, and a reference numeral Fc represents adhesion force between the toner 17 and the recording medium 12. The fixing device 6 melts and adheres the toner 17 transferred on the recording medium 12 with the fixing roller 6*b* heated by the halogen lamp 6*a*. Here, in a case where the fixing roller 6*b* applies excess heat to the toner 17 and recording medium 12, fluidity of the toner 17 becomes excessive, causing a poor-quality image (also referred to as hot offset) by adhesion of the toner 17 to the fixing roller 6*b* instead of adhesion of the toner 17 to the recording medium 12. In other words, in a case where the fluidity of the toner 17 becomes excessive, the cohesion force Fb of the toner 17 becomes smaller than the adhesion force Fa between the toner 17 and the fixing roller 6*b* (Fa>Fb), causing the hot offset. On the other hand, in a case where the fixing roller 6*b* applies inadequate heat to the toner 17 and recording medium 12, the toner 17 is not adequately melted or is not permeated through the recording medium 12, causing another poor-quality image (also referred to as cold offset) by peeling the toner 17 from the recording medium 12. In other words, where the adhesion force Fc between the toner 17 and the recording medium 12 becomes smaller than the adhesion force Fa between toner 17 and the fixing roller 6*b* (Fa>Fc), causing the cold offset. Therefore, where the fixing roller 6*b* applies adequate heat to the toner 17 and the recording medium 12, and where a relationship Fa<Fb<Fc is satisfied, a good-quality image can be printed.

Figure 5:
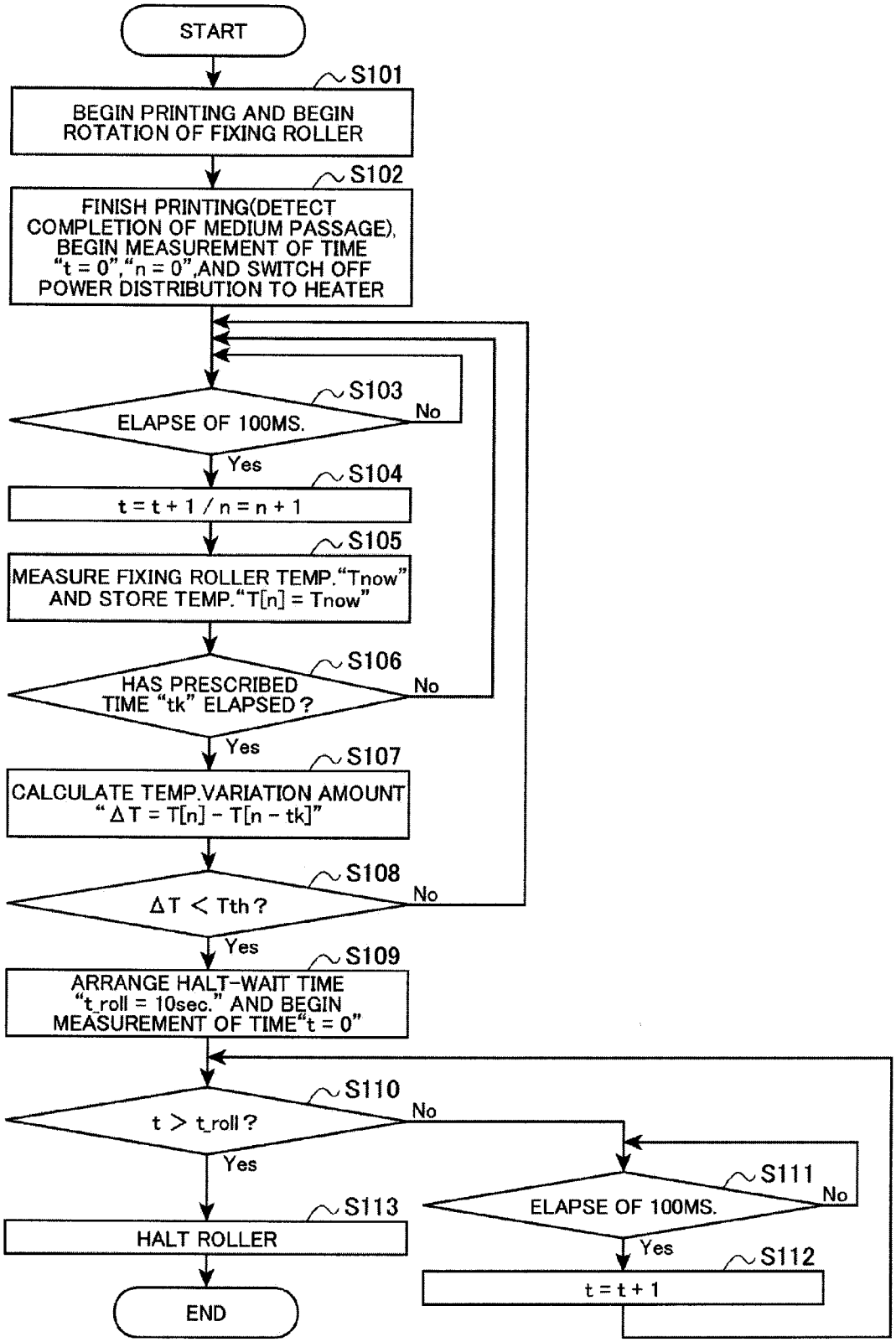
FIG. 5 is a flowchart illustrating an example procedure for operating the image forming apparatus of FIG. 1.

Referring to FIG. 5, an example procedure for operating the image forming apparatus 100 according to the first embodiment of the present invention is illustrated. Upon detection of a print instruction output from the main controller 60 thorough the connected personal computer or the operation unit 61 by monitoring the control signal, the print control unit 1 detects the surface temperature of the fixing roller 6*b* by the fixing roller thermistor 6*d*. When the surface temperature of the fixing roller 6*b* in a halt state detected by the fixing roller thermistor 6*d* is controlled to be within a prescribed fixable temperature range (i.e., within a prescribed temperature range with respect to target temperature "Ttarget" arranged), the print control unit 1 begins the print operation. Here, the target temperature "Ttarget" represents temperature to be targeted by the print control unit 1 to control the temperature of the fixing roller 6*b* through the power distribution control unit 16. Here, in a case where the surface temperature of the fixing roller 6*b* detected by the fixing roller thermistor 6*d* is not within the prescribed fixable temperature range, the print control unit 1 instructs the power distribution control unit 16 to apply prescribed voltage to the halogen lamp 6*a*. Subsequently, the halogen lamp 6*a* applied with the voltage is heated, so that the fixing roller 6*b* is heated until reaching the fixable temperature. On the other hand, in a case where the surface temperature of the fixing roller 6*b* detected by the fixing roller thermistor 6*d* is within the prescribed fixable temperature range, the print control unit 1 begins the print operation without such warm-up.

The remaining sheet amount sensor 7 transmits the signal relating to the presence or absence of the recording medium 12 stored in the sheet cassette 11 to the print control unit 1. The print control unit 1 detects whether or not the recording medium 12 is stored in the sheet cassette 11 based on the detection signal transmitted from the remaining sheet amount sensor 7. Upon detecting the presence of the recording medium 12 to be used for the print operation, the print control unit 1 begins conveyance of the recording medium 12. Simultaneously, the print control unit 1 instructs the rotation control unit 53 to drive the fixing motor 50, so that the fixing roller 6*b* and the pressure roller 6*c* are rotationally driven by the fixing motor 50 (step S101).

The recording medium 12 is conveyed to a print mechanism disposed inside the image forming apparatus 100. When the recording medium 12 reaches a position of the writing sensor 9 and is detected by the writing sensor 9, the print control unit 1 instructs the charging device power source 2*a* to apply the voltage to the charging device 2. The charging device 2 applied with the voltage according to such an instruction uniformly charges the surface of photosensitive drum 8.

Subsequently, the print control unit 1 controls the LED head 3, so that the electrostatic latent image corresponding to the received image data is formed on the surface of the photosensitive drum 8. After the electrostatic latent image is formed on the surface of the photosensitive drum 8, the print control unit 1 instructs the development power source 4*a* to apply the voltage to the development device 4. The development device 4 applied with the voltage according to such an instruction charges the toner 17 with a negative potential. Such negatively charged toner 17 is adhered to the electrostatic latent image on the surface of the photosensitive drum 8, thereby forming the toner image on the surface of the photosensitive drum 8. The toner image formed on the surface of the photosensitive drum 8 is moved to a position opposite to the transfer device 5 by rotation of the photosensitive drum 8. Here, the print control unit 1 instructs the transfer device power source 5*a* to apply the voltage to the transfer device 5. The transfer device 5 applied with the voltage according to such an instruction electrostatically attracts the toner image formed on the surface of the photosensitive drum 8, and transfers the toner image to the recording medium 12.

When the recording medium 12 having the toner image transferred thereon is conveyed to the fixing device 6, the toner image is fixed onto the recording medium 12 by application of the heat and the pressure of the fixing device 6. The recording medium 12 having the toner image fixed thereon is further conveyed and ejected to the outside the image forming apparatus 100. Here, the print control unit 1 detects a passage completion of the recording medium 12 inside the fixing device 6 (i.e., the print process is finished) based on variations of the signals detected by the writing sensor 9 and the ejection sensor 10. The print control unit 1 arranges a variable "n" to be zero (0) while initializing a time "t," and allows the time measurement unit 52 to begin the measurement using, for example, one hundred (100) milliseconds (ms) as the unit time. Simultaneously, the print control unit 1 instructs to switch off the power distribution to the power distribution control unit 16 in such a manner not to apply the excess heat from the halogen lamp 6*a* to the fixing roller 6*b* so as to reduce the overshoot (step S102).

After the unit time of 100 ms is elapsed (step S103), the print control unit 1 adds one (1) to the value of time "t" and one (1) to the variable "n" (step S104). The print control unit 1 measures current temperature "Tnow" of the fixing roller 6*b* by the fixing roller thermistor 6*d*, and stores in the temperature storing unit 51 as the temperature "Tnow" measured in the variable "n" numbered (step S105). For example, after the print process is finished, first temperature "Tnow" to be measured has the variable "n" of one (1) and is expressed as "T[1]=Tnow." The print control unit 1 compares the time "t" with prescribed time "tk" (step S106). Where the time "t" does not exceeds the prescribed time "tk" (No in step S106), a flow repeats step S103. Where the time "t" exceeds the prescribed time "tk" (Yes in step S106), a flow proceeds to step S107. The prescribed time "tk" represents a value to be used to calculate a time variation amount of the temperature. For example, where a value of "k" is arranged to be 10, the prescribed time "tk" is "100 ms×10=1 sec." In other words, the print control unit 1 repeatedly measures the temperature "Tnow" of the fixing roller 6*b* by the fixing roller thermistor 6*d* with respect to each time "t" until the time "t" becomes the prescribed time "tk" in step S103 through step S106. Subsequently, values of the temperature "Tnow" measured are sequentially stored in the temperature storing unit 51.

After the prescribed time "tk" is elapsed, the print control unit 1 calculates a temperature variation amount "ΔT" per prescribed time "tk" based on the information relating to the temperature stored in the temperature storing unit 51 (step S107). The temperature variation amount "ΔT" represents a temperature difference between the current temperature "T[n]" and temperature before the prescribed time "T[n−tk]," and is calculated by an expression of "ΔT=T[n]−T[n−tk]." For example, where the prescribed time "tk" is one (1) second, the value "k" is ten (k=10). Consequently, the temperature variation amount "ΔT" is a difference between the current temperature "T[n]" and the temperature prior to one (1) second of "T[n−10]."

The print control unit 1 compares the temperature variation amount "ΔT" measured with a halt-threshold temperature variation amount "Tth" that is arranged beforehand (step S108). Where the temperature variation amount "ΔT" is greater than or equal to the halt-threshold temperature variation amount "Tth" (ΔT≧Tth), a flow repeats step S103. Where the temperature variation amount "ΔT" is smaller than the halt-threshold temperature variation amount "Tth" (ΔT<Tth), a flow proceeds to step S109. The halt-threshold temperature variation amount "Tth" represents a threshold value of the temperature variation amount capable of halting the fixing roller 6*b* after completion of a prescribed process. The halt-threshold temperature variation amount "Tth" is, for example, zero degree Celsius.

When the passage of the recording medium 12 is completed, the temperature of the fixing roller 6*b* causes the overshoot. Since the recording medium 12 removes the heat of the fixing roller 6*b*, the passage completion thereof causes emergence of the heat accumulated inside the fixing roller 6*b* to the surface, resulting in the overshoot. Here, the temperature variation amount "ΔT" becomes a positive value (ΔT>0). Subsequently, step S103 through step S108 are repeated, so that the fixing roller 6*b* and the pressure roller 6*c* continue to rotate while the heat of the fixing roller 6*b* is moved to the pressure roller 6*c*. Here, the power distribution to the power distribution control unit 16 is being switched off by the print control unit 1, and the surface temperature of the fixing roller 6*b* begins to decrease due to no supply of the heat from the halogen lamp 6*a* disposed inside the fixing roller 6*b*. Here, the temperature variation amount "ΔT" is changed to a negative value (ΔT<0).

In step S108, where "ΔT<Tth," the print control unit 1 arranges a halt-wait time period "t_roll." The print control unit 1 initializes the time measurement unit 52 (t=0), and restarts the time measurement (step S109). The halt-wait time period "t_roll" is arranged beforehand in such a manner that maximum achieving temperature in a case of the overshoot occurred in a post-halt rotation of the fixing roller 6*b* (i.e., in a case of the overshoot occurred after the rotation of the fixing roller 6*b* halts) does not exceed high limit temperature at which the fixing roller 6*b* may be damaged, and represents a rotation time period of the fixing roller 6*b* after the relationship of "ΔT<Tth" is satisfied.

The print control unit 1 compares the time "t" with the halt-wait time "t_roll" (step S110). Where the time "t" is smaller than or equal to the halt-wait time "t_roll" (i.e., t≦t_roll, No in step S110), a flow proceeds to step S111. Where the unit time of 100 ms is elapsed (Yes in step S111), a flow proceeds to step S112 in which the value of the time "t" is advanced by one (1) unit in the time measurement by the time measurement unit 52. The print control unit 1 compares the time "t" with the halt-wait time "t_roll" again, and repeats such a comparison until the time "t" exceeds the halt-wait time "t_roll." Where the time "t" exceeds the halt-wait time "t_roll" (t>t_roll, Yes in step S110), the print control unit 1 instructs the rotation control unit 53 to halt the fixing motor 50, and the drive of the fixing motor 50 is halted, thereby halting the rotation of each of the fixing roller 6*b* and the pressure roller 6*c* (step S113).

Figure 6:
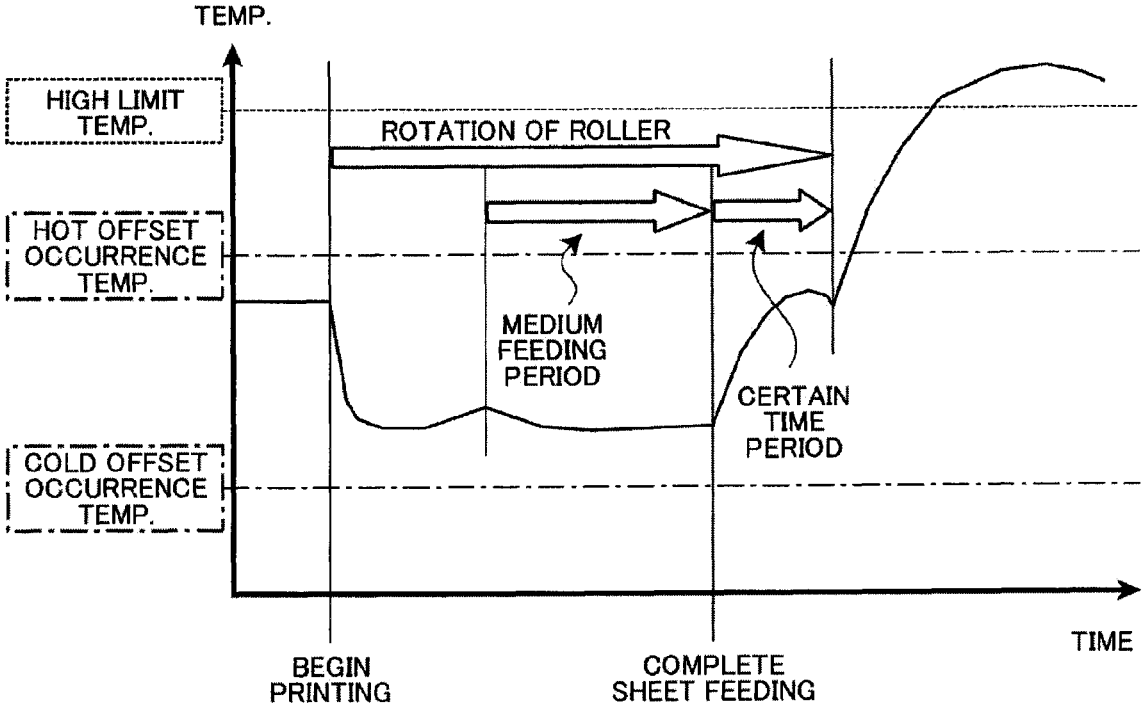
FIG. 6 PRIOR ART
FIG. 6 is a diagram illustrating a temperature variation of a fixing roller in a prior art image forming apparatus.
Figure 7:
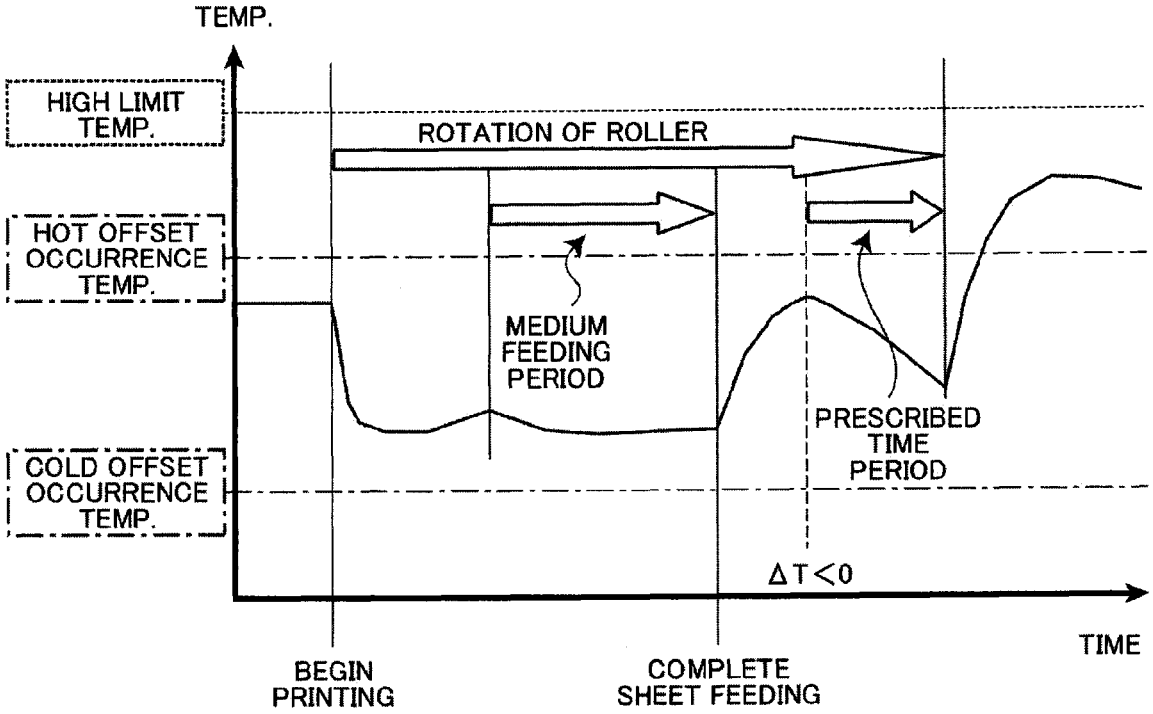
FIG. 7 is a diagram illustrating a temperature variation of a fixing roller in the image forming apparatus of FIG. 1.

Now, a temperature variation of a fixing roller 66*b* in a prior art image forming apparatus is illustrated in FIG. 6 while a temperature variation of the fixing roller 6*b* according to the first embodiment of the present invention is illustrated in FIG. 7. As mentioned above, the temperature of each of the fixing rollers 6*b* and 66*b* increases by the overshoot caused by the heat accumulated inside respective fixing rollers 6*b* and 66*b* after the sheet feeding is completed (i.e., after completion of medium passage). In the prior art image forming apparatus as illustrated in FIG. 6, rotation of the fixing roller 66*b* is halted after a certain time period is elapsed from a time of the completion of sheet feeding. In this regard, maximum achieving temperature of the fixing roller 66*b* exceeds high limit temperature. The fixing roller 66*b* needs to be rotated for a longer time period so as to reduce an occurrence of such a situation illustrated in FIG. 6. However, such extra rotation of the fixing roller 66*b* causes prolongation of a time until the subsequent print process. On the other hand, an example situation in the post-halt rotation of the fixing roller 6*b* (i.e., after the rotation of the fixing roller 6*b* is halted) according to the present invention is illustrated in FIG. 7. The rotation of the fixing roller 6*b* is halted after the prescribed time period is elapsed from a time at which the temperature variation amount "ΔT" of the fixing roller 6*b* becomes smaller than the halt-threshold temperature variation amount "Tth" (ΔT<0), so that the maximum achieving temperature of the surface of the fixing roller 6*b* is controlled in such a manner not to exceed the high limit temperature.

Therefore, the image forming apparatus 100 according to the first embodiment of the present invention measures the temperature variation amount "ΔT" of the fixing roller 6*b* by the fixing roller thermistor 6*d* detecting the temperature of the fixing roller 6*b*, and controls in such a manner that the print control unit 1 halts the rotation drive of the fixing roller 6*b* at the prescribed time after the temperature variation amount "ΔT" becomes smaller than the halt-threshold temperature variation amount "Tth," thereby reducing the overshoot after the rotation of the fixing roller 6*b* halts. Moreover, the image forming apparatus 100 according to the first embodiment of the present invention can shorten the rotation time period of the fixing roller 6*b* while reducing the overshoot, thereby shortening a time period until the subsequent print process.

Second Embodiment

Figure 8:
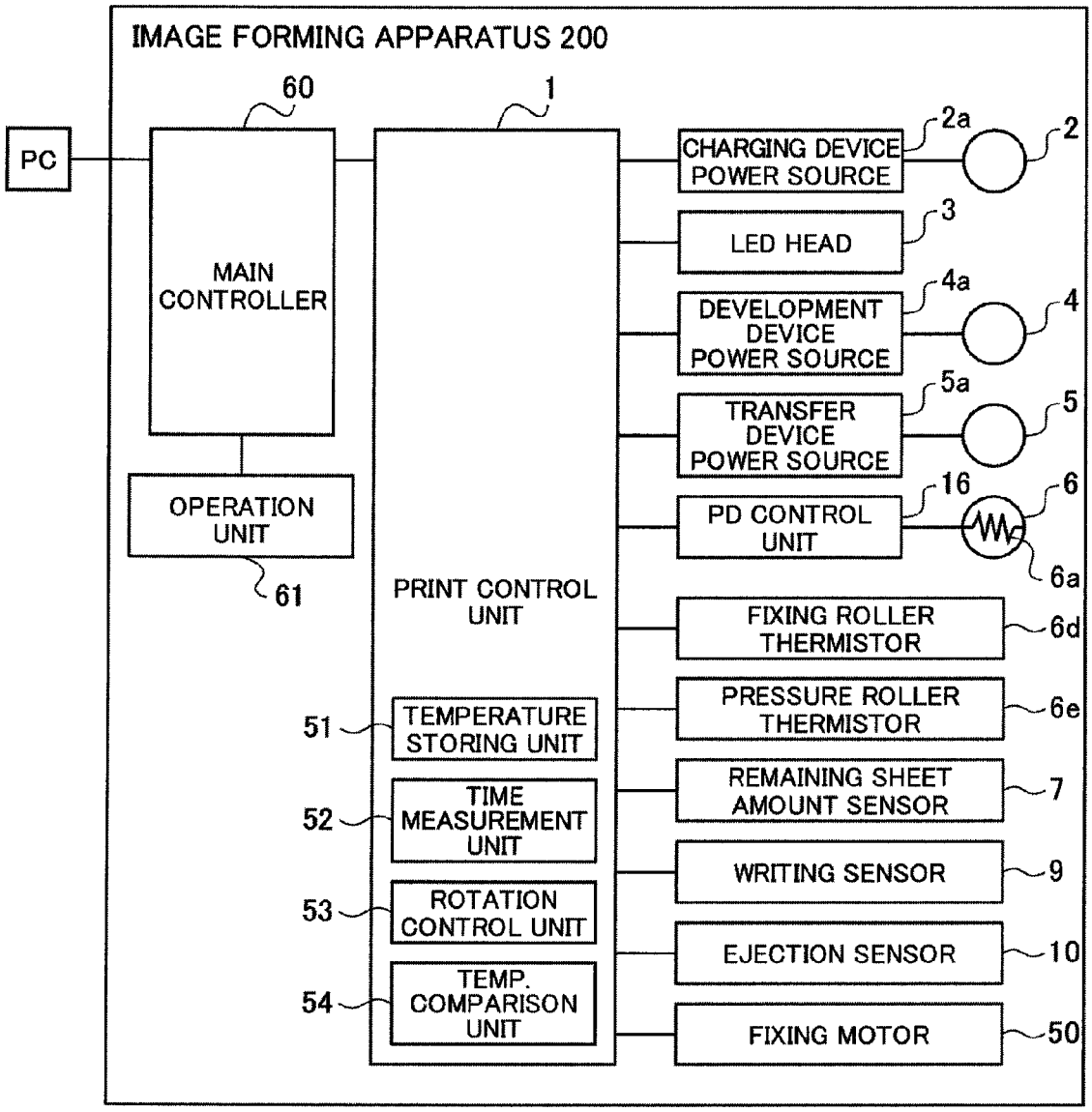
FIG. 8 is a block diagram illustrating print control of an image forming apparatus according to a second embodiment of the present invention.

Referring to FIG. 8, an image forming apparatus 200 according to a second embodiment of the present invention is illustrated in a block diagram. The image forming apparatus 200 is similar to the image forming apparatus 100 described above in the first embodiment except for a temperature comparison unit 54 that is disposed inside a print control unit 1. Components, configurations, and elements that are similar to those of the above embodiment will be given the same reference numerals as above and description thereof will be omitted. The image forming apparatus 200 halts rotation of a roller where a temperature variation amount to be calculated becomes smaller than a halt-threshold temperature variation amount, and where surface temperature of a fixing roller 6*b* becomes lower than threshold temperature.

The temperature comparison unit 54 compares temperature "T[n]" with threshold temperature "Tth_roll" to halt the rotation drive of the fixing roller 6*b*. The temperature "T[n]" represents the surface temperature of the fixing roller 6*b* and is stored in a temperature storing unit 51. The threshold temperature "Tth_roll" represents a value of temperature determined in response to target temperature "Ttarget." The threshold temperature "Tth_roll" is arranged beforehand in response to the target temperature "Ttarget" in such a manner that maximum achieving temperature in a case of overshoot occurred in the post-halt rotation of the fixing roller 6*b* does not exceed a printable temperature range. The threshold temperature "Tth_roll" represents temperature at which the rotation of the fixing roller 6*b* is halted where the temperature variation amount "ΔT" becomes smaller than a halt-threshold temperature variation amount "Tth" (ΔT<Tth). For example, "Tth_roll=Ttarget+5 degrees Celsius."

Figure 9:
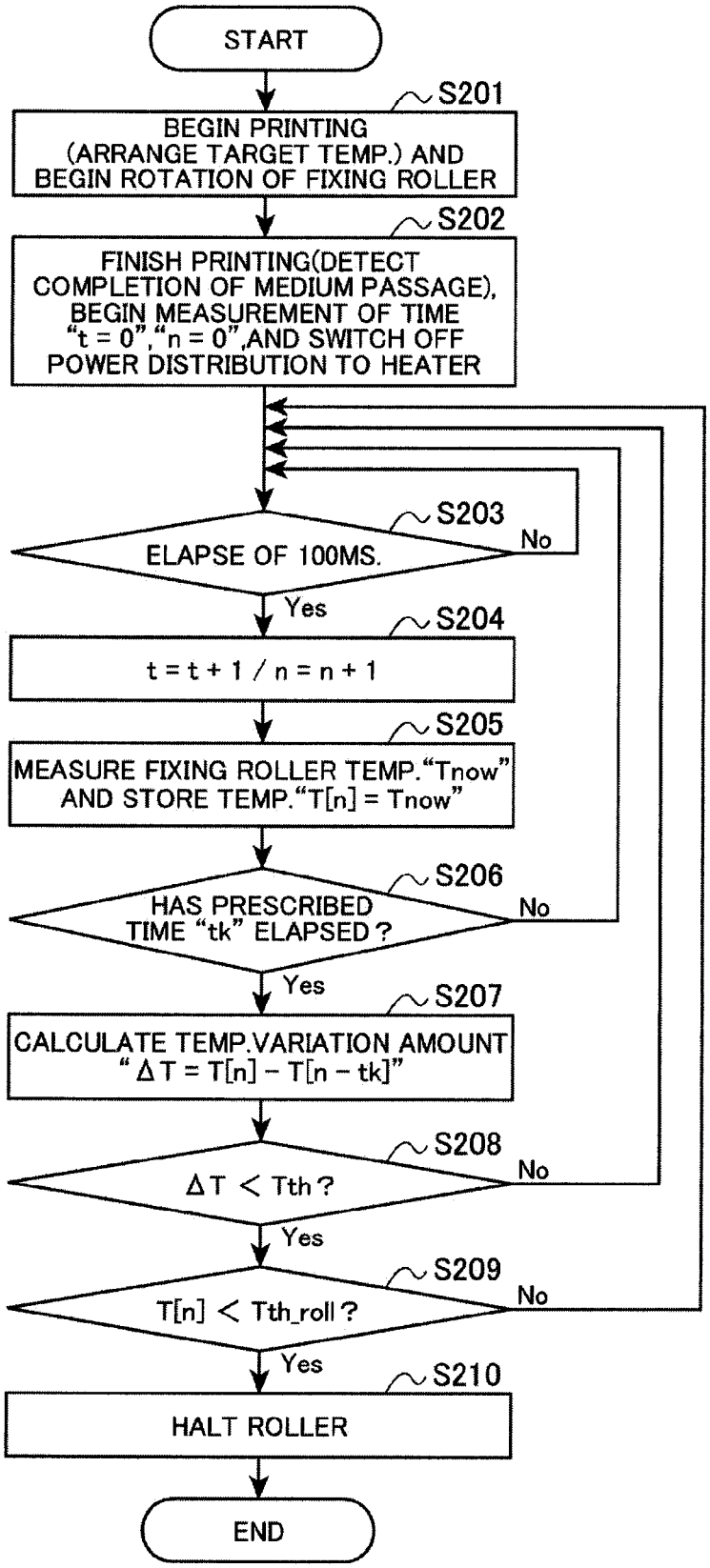
FIG. 9 is a flowchart illustrating an example procedure for operating the image forming apparatus of FIG. 8.

Referring to FIG. 9, an example procedure for operating the image forming apparatus 200 according to the second embodiment of the present invention is illustrated. Upon detection of a print instruction output from a main controller 60 thorough a connected personal computer or an operation unit 61 by monitoring the control signal, the print control unit 1 detects the surface temperature of the fixing roller 6*b* by a fixing roller thermistor 6*d*. When the surface temperature of the fixing roller 6*b* in a halt state detected by the fixing roller thermistor 6*d* is controlled to be within a prescribed fixable temperature range (i.e., within a prescribed temperature range with respect to target temperature "Ttarget" arranged), the print control unit 1 begins the print operation. Upon detecting the presence of a recording medium 12 to be used for the print operation, the print control unit 1 begins conveyance of the recording medium 12. Simultaneously, the print control unit 1 instructs a rotation control unit 53 to drive a fixing motor 50, so that the fixing roller 6*b* and a pressure roller 6*c* are rotationally driven by the fixing motor 50 (step S201).

Similar to the first embodiment described above, a series of the print operations are performed, the print control unit 1 detects a passage completion of the recording medium 12 inside a fixing device 6 (i.e., a print process is finished) based on variations of signals detected by a writing sensor 9 and an ejection sensor 10. The print control unit 1 arranges a variable "n" to be zero (0) while initializing a time "t," and allows a time measurement unit 52 to begin measurement using, for example, one hundred (100) milliseconds (ms) as a unit. Simultaneously, the print control unit 1 instructs to switch off power distribution to a power distribution control unit 16 in such a manner not to apply excess heat from a halogen lamp 6*a* to the fixing roller 6*b* so as to reduce the overshoot (step S202).

After the unit time of 100 ms is elapsed (step S203), the print control unit 1 adds one (1) to the value of time "t" and one (1) to the variable "n" (step S204). The print control unit 1 measures current temperature "Tnow" of the fixing roller 6*b* by the fixing roller thermistor 6*d*, and stores in the temperature storing unit 51 as the temperature "Tnow" measured in the variable "n" numbered (step S205). The print control unit 1 compares the time "t" with prescribed time "tk" (step S206). Where the time "t" does not exceeds the prescribed time "tk" (No in step S206), a flow repeats step S203. Where the time "t" exceeds the prescribed time "tk" (Yes in step S206), a flow proceeds to step S207. In other words, the print control unit 1 repeatedly measures the temperature "Tnow" of the fixing roller 6*b* by the fixing roller thermistor 6*d* with respect to each time "t" until the time "t" becomes the prescribed time "tk," and measured values of the temperature "Tnow" are sequentially stored in the temperature storing unit 51.

After the prescribed time "tk" is elapsed, the print control unit 1 calculates a temperature variation amount "ΔT" per prescribed time "tk" based on the information relating to the temperature stored in the temperature storing unit 51 (step S207) as similar to step S107 described in the above first embodiment.

The print control unit 1 compares the temperature variation amount "ΔT" with the halt-threshold temperature variation amount "Tth" arranged beforehand (step S208). Where the temperature variation amount "ΔT" is greater than or equal to the halt-threshold temperature variation amount "Tth" (ΔT≧Tth, that is, No in step S208), a flow repeats step S203. Where the temperature variation amount "ΔT" is smaller than the halt-threshold temperature variation amount "Tth" (ΔT<Tth, Yes in step S208), a flow proceeds to step S209.

By the temperature comparison unit 54, the print control unit 1 compares the temperature "T[n]" of the "n" numbered stored in the temperature storing unit 51 in step S205 with the threshold temperature "Tth_roll" determined in response to the arranged target temperature "Ttarget" (step S209). Where the temperature "T[n]" is higher than or equal to the threshold temperature "Tth_roll" (T[n]≧Tth_roll, that is No in step S209), a flow repeats step S203 through step S209 until the temperature "T[n]" becomes lower than the threshold temperature "Tth_roll." Where the temperature "T[n]" becomes lower than the threshold temperature "Tth_roll" (T[n]<Tth_roll, Yes in step S209), the print control unit 1 instructs the rotation control unit 53 to halt the fixing motor 50, and the drive of the fixing motor 50 is halted, thereby halting the rotation of each of the fixing roller 6*b* and the pressure roller 6*c* (step S210).

Figure 10:
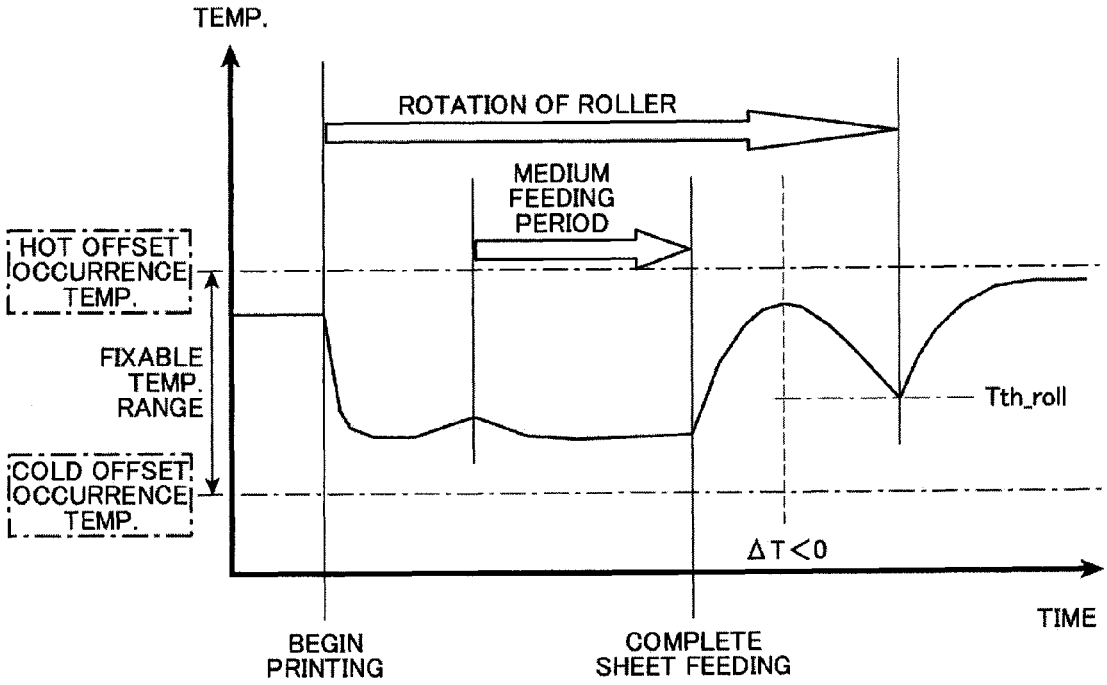
FIG. 10 is a diagram illustrating a temperature variation of a fixing roller in the image forming apparatus of FIG. 8.
Figure 11:
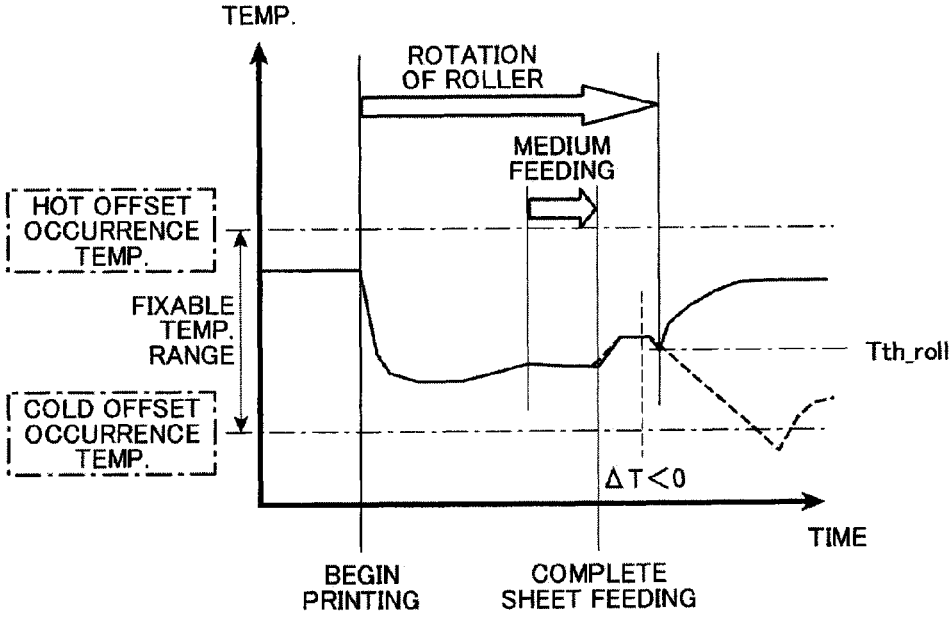
FIG. 11 is another diagram illustrating a temperature variation of a fixing roller in the image forming apparatus of FIG. 8.

Referring to FIGS. 10 and 11, the temperature variations of the fixing roller 6*b* according to the image forming apparatus 200 of the second embodiment are illustrated. As illustrated in FIGS. 10 and 11, the temperature of the fixing roller 6*b* varies from a time at which the print process begins to a time after the fixing roller 6*b* halts. FIG. 10 illustrates a situation of high temperature in a case of the overshoot while FIG. 11 illustrates a situation of low temperature in a case of the overshoot. As illustrated in FIG. 10, in a case where the temperature is relatively high in the overshoot (i.e., a degree of the overshoot is large), not only a time period needed for the temperature variation amount "ΔT" to become smaller than the halt-threshold temperature variation amount "Tth" (ΔT<0) is adequately long, but also a subsequent time period needed for the temperature "T[n]" of the fixing roller 6*b* to reach the threshold temperature "Tth_roll" is adequately long. Therefore, the temperature of the fixing roller 6*b* in the post-halt rotation is controlled to be lower than hot offset occurrence temperature. Moreover, in a case where the temperature is relatively low in the overshoot (a degree of the overshoot is small) as illustrated in FIG. 11, not only a time period needed for the temperature variation amount "ΔT" to become smaller than the halt-threshold temperature variation amount "Tth" (ΔT<0) is short, but also a subsequent time period needed for the temperature "T[n]" of the fixing roller 6*b* to reach the threshold temperature "Tth_roll" is significantly short. Therefore, the temperature of the fixing roller 6*b* in the post-halt rotation is controlled to be higher than cold offset occurrence temperature. According to a process of the first embodiment, in a case where the degree of the overshoot is small, the temperature of the fixing roller 6*b* becomes excessively low and reaches a level lower than the cold offset occurrence temperature as indicated by a dashed line shown in FIG. 11. Consequently, when the subsequent print process begins, a time for temperature adjustment may be needed.

The image forming apparatus 200 according to the second embodiment compares the temperature "T[n]" of the fixing roller 6*b* with the threshold temperature "Tth_roll" when the temperature variation amount "ΔT" becomes smaller than the halt-threshold temperature variation amount "Tth," and controls in such a manner that the print control unit 1 halts the rotation drive of the fixing roller 6*b* by lowering the temperature "T[n]" of the fixing roller 6*b* relative to the threshold temperature "Tth_roll." Consequently, the temperature of the fixing roller 6*b* in the post-halt rotation can be controlled within the printable temperature range. Therefore, when the subsequent print process begins, the time for temperature adjustment is not needed, thereby providing the image forming apparatus 200 having a capability of relatively high print throughput.

Third Embodiment

Figure 12:
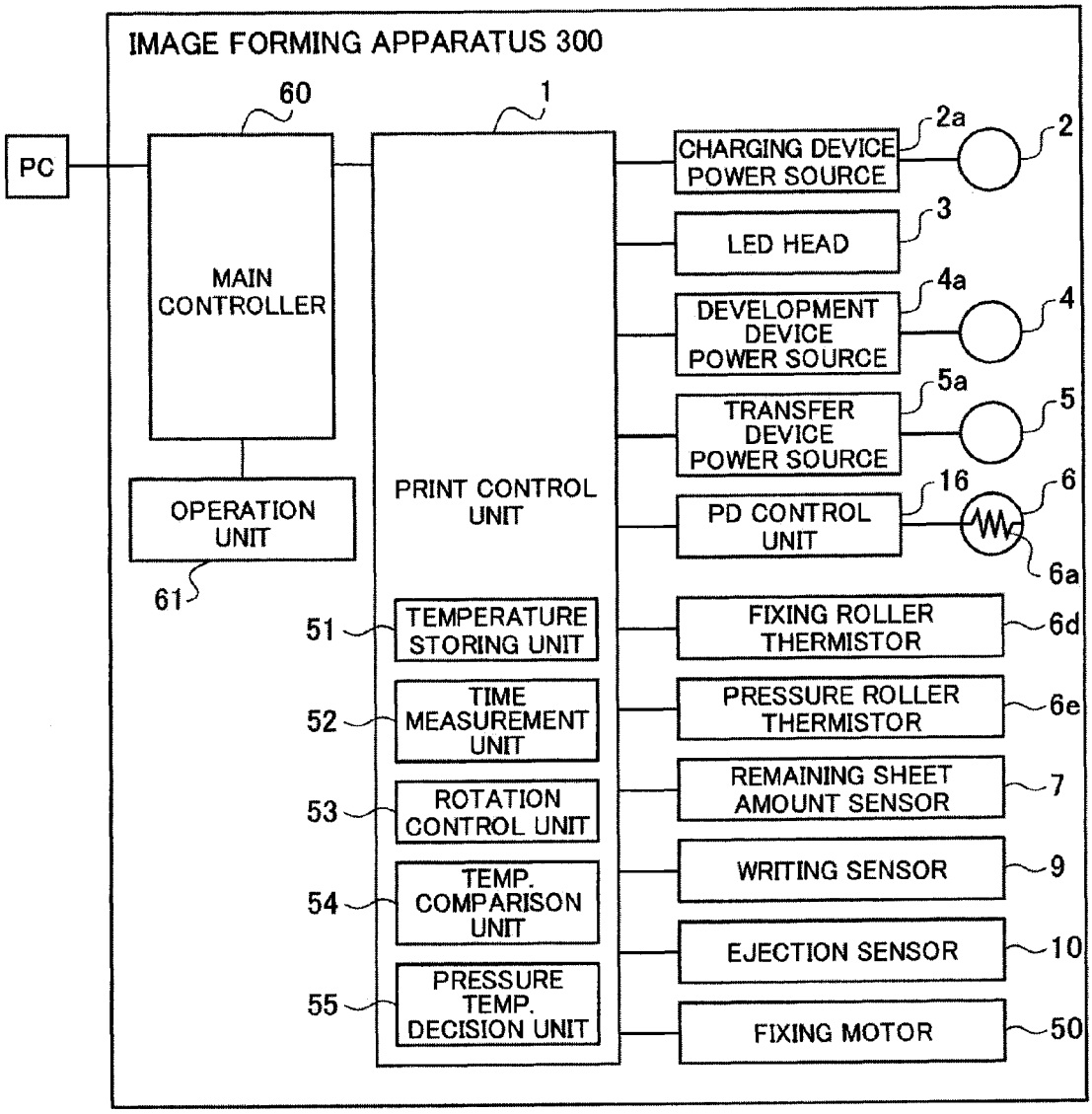
FIG. 12 is a block diagram illustrating print control of an image forming apparatus according to a third embodiment of the present invention.

Referring to FIG. 12, an image forming apparatus 300 according to a third embodiment of the present invention is illustrated in a block diagram. The image forming apparatus 300 is similar to the image forming apparatus 200 described above in the second embodiment except for a pressure temperature decision unit 55 that is disposed in a print control unit 1. Components, configurations, and elements that are similar to those of the above second embodiment will be given the same reference numerals as above and description thereof will be omitted. The image forming apparatus 300 halts rotation of a roller where a temperature variation amount to be calculated becomes smaller than a halt-threshold temperature variation amount, and where surface temperature of the fixing roller 6*b* becomes lower than threshold temperature to be arranged based on surface temperature of a pressure roller 6*c*.

The pressure temperature decision unit 55 stores information relating to the temperature of the pressure roller 6*c* measured by a pressure roller thermistor 6*e*, and arranges halt-threshold temperature "Tth_roll_lw" by calculation based on the temperature of the pressure roller 6*c*. The halt-threshold temperature "Tth_roll_lw" is calculated with respect to each temperature of the pressure roller 6*c* in such a manner that maximum achieving temperature in a case of overshoot occurred in post-halt rotation of the fixing roller 6*b* does not exceed a printable temperature range, and represents temperature at which the rotation of the fixing roller 6*b* is halted after the temperature variation amount "ΔT" becomes smaller than a halt-threshold temperature variation amount "Tth" (ΔT<Tth). Such calculated temperature is arranged as the halt-threshold temperature "Tth_roll_lw."

Now, the calculation of the halt-threshold temperature "Tth_roll_lw" is described. The halt-threshold temperature "Tth_roll_lw" is calculated by a liner expression, with a coefficient experimentally determined according to a print condition such as rotation speed of the roller, thickness of a recording medium 12, and target temperature "Ttarget" arranged in a temperature comparison unit 54, using temperature of the pressure roller 6*c* stored in the pressure temperature decision unit 55 after the print process. Such a liner expression is stored in the pressure temperature decision unit 55.

Figure 13:
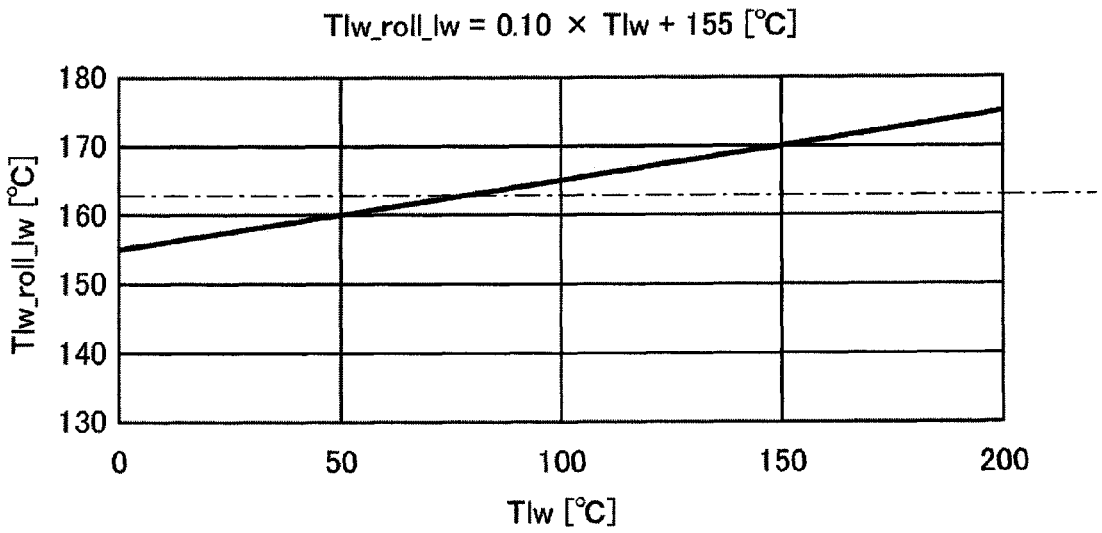
FIG. 13 is a graph illustrating an example of a linear expression used to calculate halt-threshold temperature in the image forming apparatus of FIG. 12.
Figure 14:
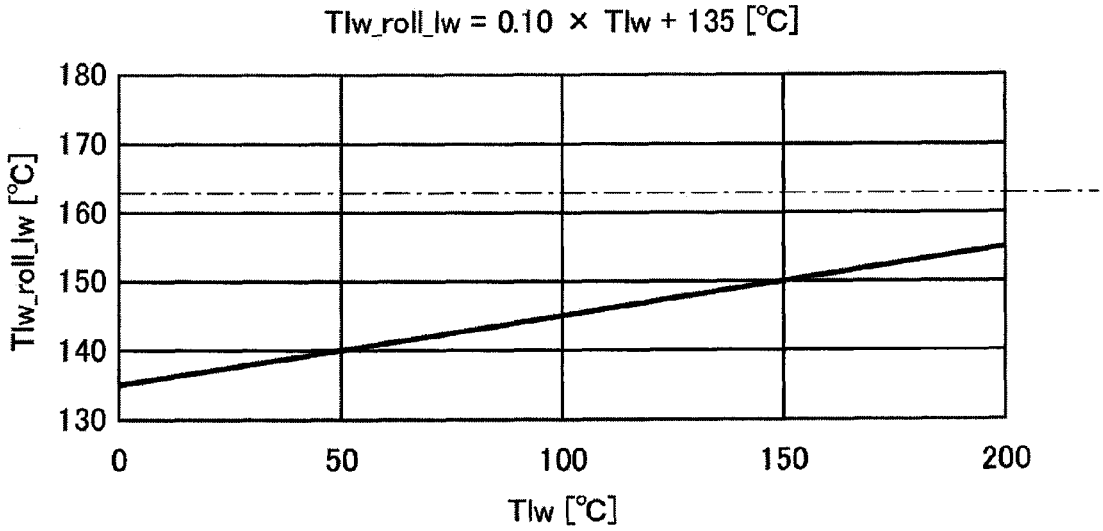
FIG. 14 is another graph illustrating an example of a linear expression used to calculate halt-threshold temperature in the image forming apparatus of FIG. 12.
Figure 15:
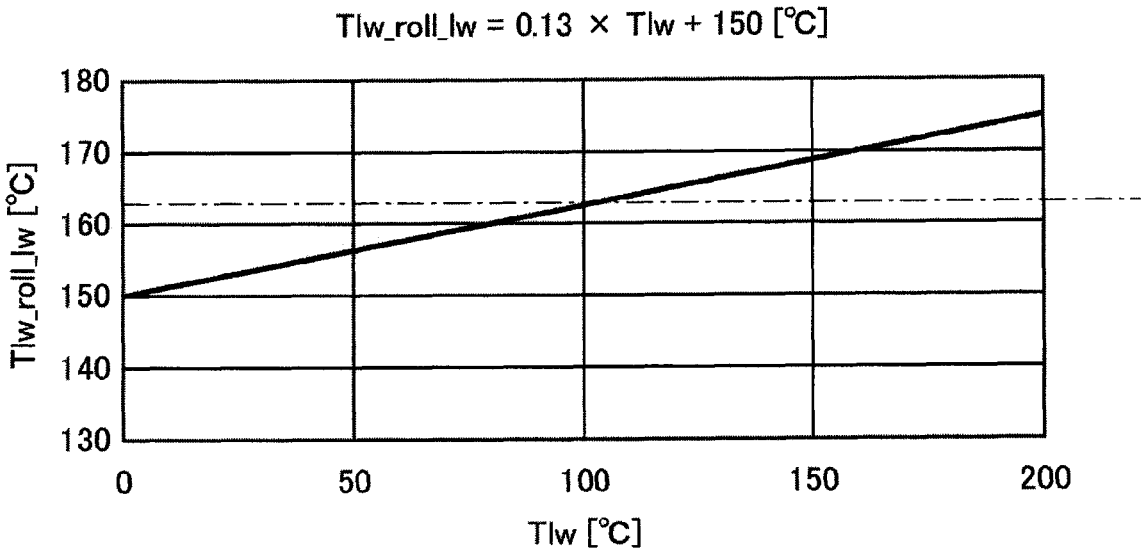
FIG. 15 is another graph illustrating an example of a linear expression used to calculate halt-threshold temperature in the image forming apparatus of FIG. 12.

For example, where the target temperature "Ttarget" is one hundred seventy (170) degrees, the linear expression of "Tt_roll_lw=0.10×Tlw+155" is experimentally determined as illustrated in FIG. 13. Where the temperature of the pressure roller 6*c* is fifty (50) degrees, the halt-threshold temperature "Tth_roll_lw" is calculated to be one hundred sixty (160) degrees. Where the temperature of the pressure roller 6*c* is one hundred fifty (150) degrees, the halt-threshold temperature "Tth_roll_lw" is calculated to be one hundred seventy (170) degrees. That is, the lower the temperature of the pressure roller 6*c*, the lower the temperature of the halt-threshold temperature "Tth_roll_lw" to be arranged.

Where the target temperature "Ttarget" is one hundred fifty (150) degrees that is lower than the above example shown in FIG. 13, another liner expression of "Tth_roll_low=0.10×Tlw+135" is experimentally determined as illustrated in FIG. 14. Since the target temperature "Ttarget" is low, the rotation of each of the fixing roller 6*b* and the pressure roller 6*c* needs to be halted at lower temperature as illustrated in FIG. 14. Moreover, where the target temperature "Ttarget" is one hundred seventy (170) degrees and the rotation speed of the roller is faster than the above example, another liner expression of "Tth_roll_lw=0.13×Tlw+150" is experimentally determined. The faster the print speed, the greater the amount of the heat accumulated inside the roller. Consequently, the rotation of each of the fixing roller 6*b* and the pressure roller 6*c* needs to be halted at lower temperature. Therefore, the liner expression to calculate the halt-threshold temperature "Tth_roll_lw" can be selected depending upon the print condition such as the target temperature "Ttarget", the rotation speed of the roller, and the thickness of the recording medium 12, thereby calculating suitable halt-threshold temperature "Tth_roll_lw" in response to the temperature of the pressure roller 6*c*.

Figure 16:
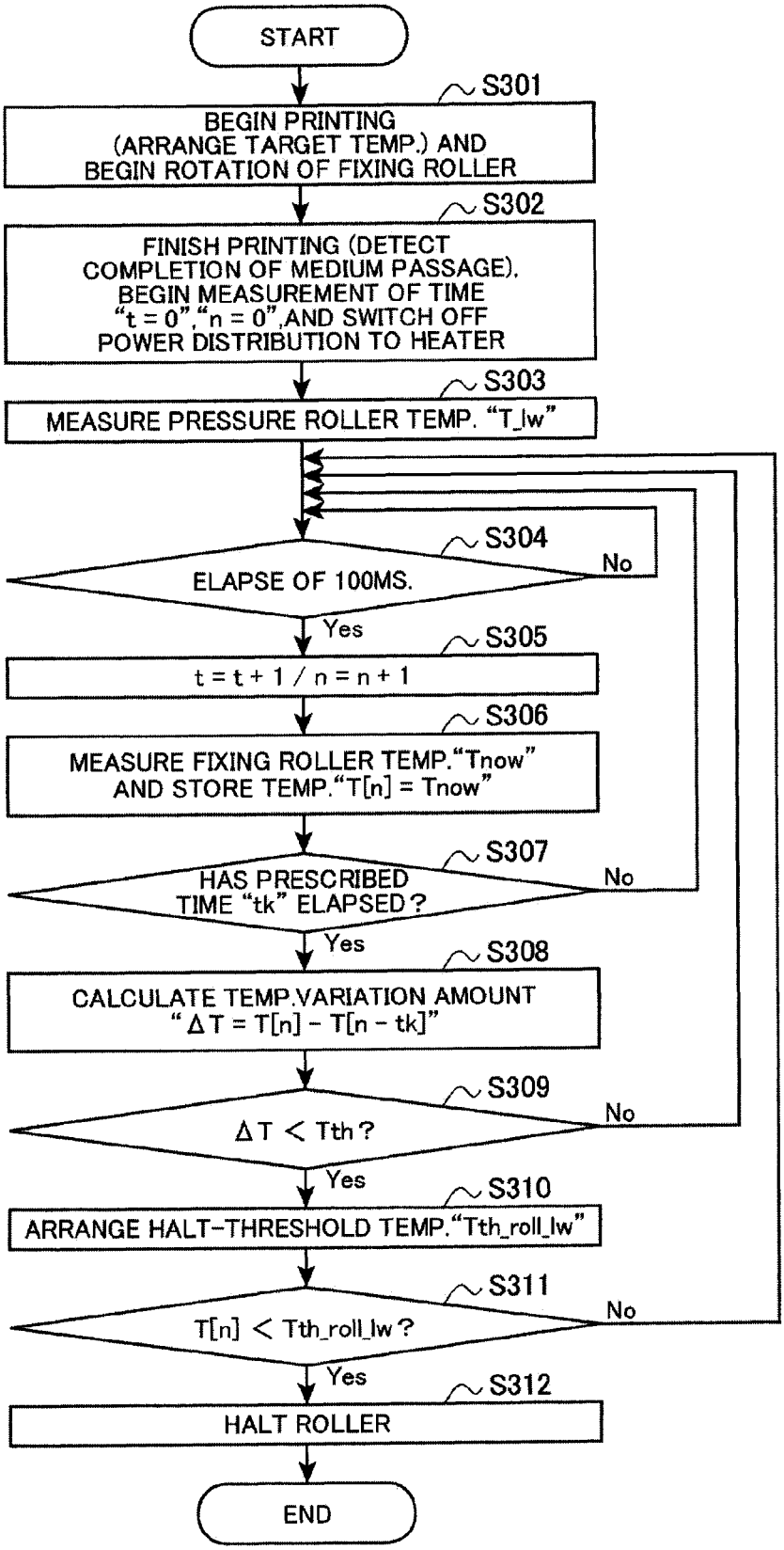
FIG. 16 is a flowchart illustrating an example procedure for operating the image forming apparatus of FIG. 12.

Referring to FIG. 16, an example procedure for operating the image forming apparatus 300 according to a third embodiment of the present invention is illustrated. Upon detection of a print instruction output from a main controller 60 thorough a connected personal computer or an operation unit 61 by monitoring the control signal, the print control unit 1 detects the surface temperature of the fixing roller 6*b* by a fixing roller thermistor 6*d*. When the surface temperature of the fixing roller 6*b* in a halt state detected by the fixing roller thermistor 6*d* is controlled to be within a prescribed fixable temperature range (i.e., within a prescribed temperature range with respect to target temperature "Ttarget" arranged), the print control unit 1 begins the print operation. Upon detecting the presence of a recording medium 12 to be used for the print operation, the print control unit 1 begins conveyance of the recording medium 12. Simultaneously, the print control unit 1 instructs a rotation control unit 53 to drive a fixing motor 50, so that the fixing roller 6*b* and a pressure roller 6*c* are rotationally driven by the fixing motor 50 (step S301).

Similar to the first embodiment described above, a series of the print operations are performed, the print control unit 1 detects a passage completion of the recording medium 12 inside a fixing device 6 (i.e., a print process is finished) based on variations of signals detected by a writing sensor 9 and an ejection sensor 10. The print control unit 1 arranges a variable "n" to be zero (0) while initializing a time "t," and allows a time measurement unit 52 to begin measurement using, for example, one hundred (100) milliseconds (ms) as a unit. Simultaneously, the print control unit 1 instructs to switch off power distribution to a power distribution control unit 16 in such a manner not to apply excess heat from a halogen lamp 6*a* to the fixing roller 6*b* so as to reduce the overshoot (step S302).

The print control unit 1 detects temperature T_lw of the pressure roller 6*c* by the pressure roller thermistor 6*e* (step S303).

After the unit time of 100 ms is elapsed (step S304), the print control unit 1 adds one (1) to the value of time "t" and one (1) to the variable "n" (step S305). The print control unit 1 measures current temperature "Tnow" of the fixing roller 6*b* by the fixing roller thermistor 6*d*, and stores in the temperature storing unit 51 as the temperature "Tnow" measured in the variable "n" numbered (step S306). The print control unit 1 compares the time "t" with prescribed time "tk" (step S307). Where the time "t" does not exceeds the prescribed time "tk" (No in step S307), a flow repeats step S304. Where the time "t" exceeds the prescribed time "tk" (Yes in step S307), a flow proceeds to step S308. In other words, the print control unit 1 repeatedly measures the temperature "Tnow" of the fixing roller 6*b* by the fixing roller thermistor 6*d* with respect to each time "t" until the time "t" becomes the prescribed time "tk," and measured values of the temperature "Tnow" are sequentially stored in the temperature storing unit 51.

After the prescribed time "tk" is elapsed, the print control unit 1 calculates a temperature variation amount "ΔT" per prescribed time "tk" based on the information relating to the temperature stored in the temperature storing unit 51 as similar to the above first embodiment (step S308).

The print control unit 1 compares the temperature variation amount "ΔT" with the halt-threshold temperature variation amount "Tth" arranged beforehand (step S309). Where the temperature variation amount "ΔT" is greater than or equal to the halt-threshold temperature variation amount "Tth" (ΔT≧Tth, that is, No in step S309), a flow repeats step S304. Where the temperature variation amount "ΔT" is smaller than the halt-threshold temperature variation amount "Tth" (ΔT<Tth, Yes in step S309), a flow proceeds to step S310.

The print control unit 1 calculates the halt-threshold temperature "Tth_roll_lw" suitable for a current print condition by the pressure temperature decision unit 55 based on the liner expression calculating the halt-threshold temperature "Tth_roll_lw" as described above and the temperature "T_lw" of the pressure roller 6*c* stored in the pressure temperature decision unit 55 in step S303, and then arranges in the pressure temperature decision unit 55 (step S310).

By the temperature comparison unit 54, the print control unit 1 compares the arranged halt-threshold temperature "Tth_roll_lw" with the temperature "T[n]" of "n" numbered stored in the temperature storing unit 51 in step S306 (step S311). Where the temperature "T[n]" is higher than or equal to the halt-threshold temperature "Tth_roll_lw" (T[n]≧Tth_roll_lw, that is, No in step S311), a flow repeats step S304 through step S310 until the temperature "T[n]" becomes lower than the halt-threshold temperature "Tth_roll_lw." Where the temperature "T[n]" becomes lower than the halt-threshold temperature "Tth_roll_lw" (T[n]<Tth_roll_lw, Yes in step S311), the print control unit 1 instructs the rotation control unit 53 to halt the fixing motor 50, and the drive of the fixing motor 50 is halted, thereby halting the fixing roller 6*b* and the pressure roller 6*c* (step S312).

Figure 17:
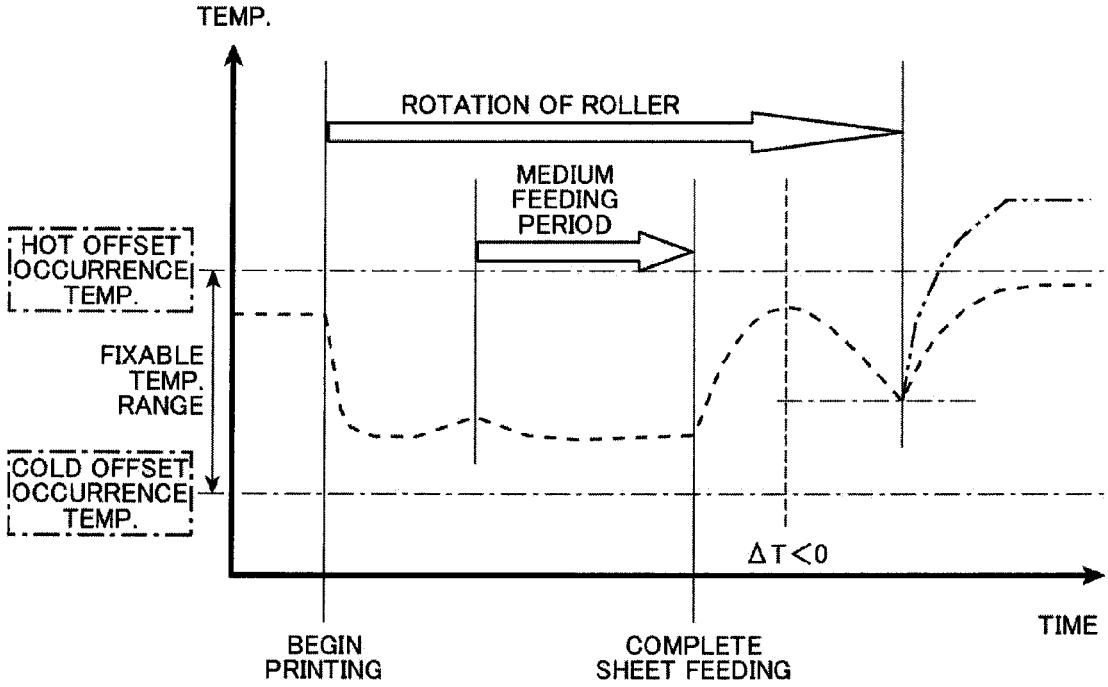
FIG. 17 is a diagram illustrating a temperature variation of a fixing roller caused by a difference in a degree of overshoot after rotation of the fixing roller halts.

Referring to FIG. 17, a temperature variation of the fixing roller 6*b* is illustrated. Such a temperature variation is generated by a difference in a degree of the overshoot after the rotation of the roller halts. After the temperature variation amount "ΔT" becomes smaller than the halt-threshold temperature variation amount "Tth," the temperature of the fixing roller 6*b* reaches a prescribed level. In this way, in a case where the temperature of the pressure roller 6*c* is high, the degree of the overshoot is relatively small as indicated by a dashed line in FIG. 17 even when the fixing roller 6*b* and the pressure roller 6*c* are halted. In a case where the temperature of the pressure roller 6*c* is low, on the other hand, the degree of the overshoot is relatively large as indicated by a chain double dashed line in FIG. 17. In a case where the temperature of the pressure roller 6*c* is low, an amount of the temperature to be removed from the fixing roller 6*b* is relatively large while an amount of the temperature to be removed from the fixing roller 6*b* being in rotation is relatively small. Therefore, a temperature difference between the fixing roller 6*b* being in rotation and inside thereof becomes small. Consequently, in a case where the temperature of the pressure roller 6*c* is relatively low, the temperature difference between the inside and outside the fixing roller 6*b* becomes large, causing an increases in the overshoot temperature in the post-halt rotation of the roller. On the other hand, in a case where the temperature of the pressure roller 6*c* is relatively high, the overshoot temperature in the post-halt rotation of the roller decreases. In this regard, in a case where the fixing roller 6*b* and the pressure 6*c* are halted at the prescribed temperature regardless of the temperature of the pressure roller 6*c*, there is a possibility of becoming outside the printable temperature. Therefore, in consideration of influence on the temperature of the pressure roller 6*c*, the image forming apparatus 300 according to the third embodiment arranges the temperature, at which the rotation of the fixing roller 6*b* and the pressure roller 6*c* are halted, to be the halt-threshold temperature "Tth_roll_lw" in response to the temperature of the pressure roller 6*c*.

Figure 18:
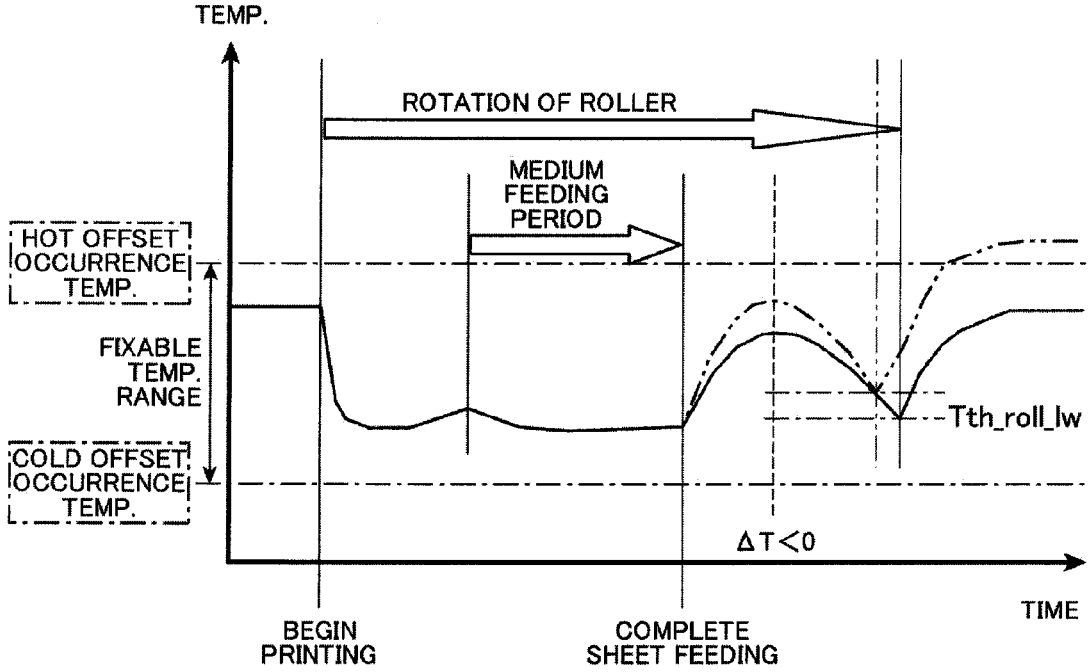
FIG. 18 is a diagram illustrating a temperature variation of a fixing roller in the image forming apparatus of FIG. 12.

Referring to FIG. 18, a temperature variation of the fixing roller 6*b* in the image forming apparatus 300 according to the third embodiment of the present invention is illustrated. The temperature variation is illustrated from a time at which the print process begins to a time after the rotation of the fixing roller 6*b* halts. A chain double dashed line indicates the temperature variation in a case where the temperature at which the roller is halted is at a constant level. A solid line indicates the temperature variation in a case where the halt-threshold temperature "Tth_roll_lw" is arranged in response to the temperature of the pressure roller 6*c*. Here, each of the temperature variations in the chain double dashed line and the solid line illustrates a situation in which the temperature of the pressure roller is relatively low. In a case where the temperature at which the roller is halted is at the constant level, the degree of the overshoot in the post-halt rotation of the roller becomes large due to the low temperature of the pressure roller 6*c*, causing beyond hot offset occurrence temperature. On the other hand, in a case where the halt-threshold temperature "Tth_roll_lw" is arranged in response to the temperature of the pressure roller 6*c*, a time period needed to halt the roller becomes long as lower temperature is arranged as the halt-threshold temperature "Tth_roll_lw" in response to the temperature of the pressure roller 6*c*. Such an arrangement prolongs a time period until the roller halts, thereby adequately removing heat from the fixing roller 6*b*. Therefore, the temperature in the overshoot in the post-halt rotation of the roller is controlled within the fixable temperature range, so that a temperature adjustment is not needed when the subsequent print process begins.

The image forming apparatus 300 according to the third embodiment compares the temperature "T[n]" of the fixing roller 6*b* with the halt-threshold temperature "Tth_roll_lw" when the temperature variation amount "ΔT" becomes smaller than the halt-threshold temperature variation amount "Tth," and controls in such a manner that the print control unit 1 halts the rotation drive of the fixing roller 6*b* by lowering the temperature "T[n]" of the fixing roller 6*b* relative to the threshold temperature "Tth_roll_lw." A value of the threshold temperature "Tth_roll_lw" is arranged to be suitable in response to the temperature of the pressure roller 6*c*. Therefore, the temperature of the fixing roller 6*b* in the post-halt rotation can be controlled within the printable temperature range regardless of the temperature of the pressure roller 6*c*. Therefore, when the subsequent print process begins, the temperature adjustment time is not needed, thereby providing the image forming apparatus 300 having a capability of relatively high print throughput.

Fourth Embodiment

Figures 19, 20:
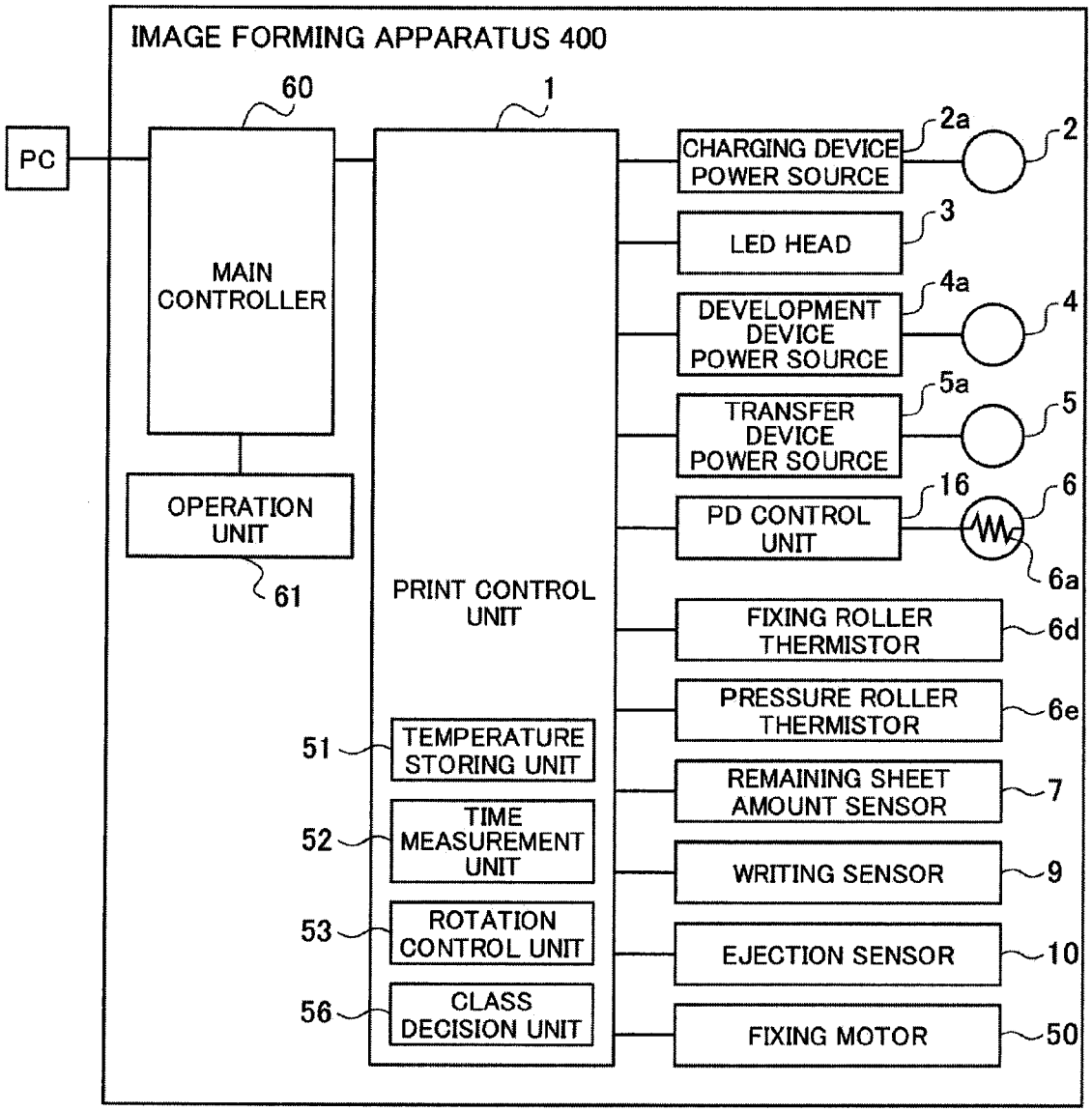
FIG. 19 is a block diagram illustrating print control of an image forming apparatus according to a fourth embodiment of the present invention.
FIG. 20 is a diagram illustrating a halt-wait time period in response to thickness of a recording medium in the image forming apparatus of FIG. 19.

Referring to FIG. 19, an image forming apparatus 400 according to a fourth embodiment of the present invention is illustrated in a block diagram. The image forming apparatus 400 is similar to the image forming apparatus 100 described above in the first embodiment except for a class decision unit 56 that is disposed in a print control unit 1. Components, configurations, and elements that are similar to those of the above second embodiment will be given the same reference numerals as above and description thereof will be omitted. The image forming apparatus 400 changes, depending upon a class of a recording medium 12 to be used, a prescribed time period until rotation of a roller halts. According to the fourth embodiment, thickness is described as the class of the recording medium 12, but the present invention is not limited thereto.

The class decision unit 56 stores a halt-wait time period "t_roll" in response to thickness of the recording medium 12 to be used as illustrated in FIG. 20. The class decision unit 56 arranges the halt-wait time period based on the thickness arranged from the operation unit 61 to the print control unit 1. For example, the halt-wait time period is arranged in response to the thickness of the recording medium 12 which is arranged after a print process is finished. For example, in a case where a thin sheet of paper is arranged from the operation unit 61, the halt-wait time period t_roll becomes five (5) seconds. In a case where a normal sheet of paper is arranged, the halt-wait time period t_roll becomes ten (10) seconds. In a case where a thick sheet of paper is arranged, the halt-wait time period t_roll becomes twenty (20) seconds. Where the print process begins, a value of such a halt-wait time period t_roll is arranged in response to the thickness of the recording medium 12 arranged from the operation unit 61 to the print control unit 1, instead of a certain value arranged in step S109 described in the first embodiment. In other words, when the print process begins, the thickness of the recording medium 12 to be used is arranged from the operation unit 61 to the print control unit 1 through the main controller 60. After a temperature variation amount "ΔT" becomes smaller than a halt-threshold amount "Tth," the print control unit 1 arranges the halt-wait time period "t_roll" in response to the thickness of the recording medium 12 arranged previously by the class decision unit 56. In FIG. 20, ream weight represents weight of one thousand (1,000) sheets, each of which having a size of 788 mm×1,091 mm (duodecimo size used in Japan).

Therefore, the image forming apparatus 400 according to the fourth embodiment arranges the halt-wait time period "t_roll" in response to a class of the recording medium 12 to be used. For example, in a case where the thick recording medium 12 is used, a heat amount is relatively large in the course of fixing, and a heat amount inside a fixing roller 6*b* increases, thereby an accumulated heat amount inside becomes large even when the temperature variation amount "ΔT" becomes smaller than the halt-threshold variation amount "Tth." Therefore, in a case where the time period until the rotation halts is arranged to be long, a risk of reaching high limit temperature can be further reduced. On the other hand, in a case where the thin recording medium 12 is used, the heat amount is relatively small in the course of fixing, so that the accumulated heat amount inside the fixing roller 6*b* is adequately decreased at a point in a time at which the temperature variation amount "ΔT" becomes smaller than the halt-threshold variation amount "Tth." Therefore, in a case where the time period until the rotation of the fixing roller 6*b* halts is arranged to be shorter, a certain amount of the heat can be accumulated inside the fixing roller 6*b*, thereby shortening the time period until the subsequent print process.

Each of the first, second, third, and fourth embodiments described above applies to the printer as an example. However, the embodiments of the present invention are not limited to the printer and can be applied to an image forming apparatus such as a multi-functional peripheral, a facsimile machine, and a photocopier.

As can be appreciated by those skilled in the art, numerous additional modifications and variation of the present invention are possible in light of the above-described teachings. It is therefore to be understood that, within the scope of the appended claims, the disclosure of this patent specification may be practiced otherwise than as specifically described herein.

What is claimed is:

1. An image forming apparatus forming an image by fixing a developer on a recording medium with heat, the image forming apparatus comprising:

a fixing member, disposed rotatably supported, heating the recording medium;

a pressure member pressing against the fixing member;

a drive unit rotationally driving the fixing member;

a heat unit heating the fixing member;

a temperature detection unit detecting temperature of the fixing member;

a control unit controlling the heat unit and the drive unit; and a temperature record storing unit storing a temperature record of the temperature detection unit, and wherein the control unit is adapted to control, based on the temperature record of the temperature record storing unit, a rotation drive of the drive unit in a case of non-fixing, and wherein the control unit is adapted to (i) calculate a temperature variation amount per unit time by using a temperature detected at the temperature detection unit, (ii) compare the temperature variation amount per unit time with a prescribed temperature variation amount, and (iii) halt the rotation drive of the drive unit based on a comparison result, wherein the temperature variation amount per unit time is repeatedly calculated until the amount becomes lower than the prescribed temperature variation amount.

2. The image forming apparatus according to claim 1, comprising a power distribution control unit controlling power distribution to the heat unit, wherein the control unit is adapted to control the power distribution control unit in such a manner to block the power distribution to the heat unit in a case of non-fixing.

3. The image forming apparatus according to claim 1, wherein the control unit is adapted to halt the rotation drive of the drive unit after elapse of a prescribed time period where the temperature variation amount becomes smaller than the prescribed temperature variation amount.

4. The image forming apparatus according to claim 1, comprising a temperature comparison unit comparing temperature of the fixing member with a prescribed temperature, wherein the control unit is adapted to compare the temperature of the fixing member with the prescribed temperature by the temperature comparison unit and halt the rotation drive of the drive unit by lowering the temperature of the fixing member relative to the prescribed temperature where the temperature variation amount per unit time becomes smaller than the prescribed temperature variation amount.

5. The image forming apparatus according to claim 1 further comprising:

a second temperature detection unit detecting temperature of the pressure member; and a pressure temperature decision unit setting a prescribed temperature in response to the temperature of the pressure member detected by the second temperature detection unit, and wherein the control unit is adapted to compare, by a temperature comparison unit, the temperature of the pressure member with the prescribed temperature set by the pressure temperature decision unit and halt the rotation drive of the drive unit by lowering the temperature of the pressure member relative to the prescribed temperature where the temperature variation amount per unit time becomes smaller than the prescribed temperature variation amount.

6. An image forming apparatus forming an image by fixing a developer on a recording medium with heat, the image forming apparatus comprising:

a fixing member, disposed rotatably supported, heating the recording medium;

a pressure member pressing against the fixing member;

a drive unit rotationally driving the fixing member;

a heat unit heating the fixing member;

a medium class decision unit determining a thickness of the recording medium to be fixed; and a control unit controlling the heat member and the drive unit, and wherein the control unit is adapted to halt the rotation drive of the drive unit based on the thickness of the recording medium determined by the medium class decision unit in a case of of the developer not having been fixed in the recording medium.

7. The image forming apparatus according to claim 1, wherein the temperature variation amount is a variation amount of when the temperature of the fixing member decreases.

8. The image forming apparatus according to claim 1, wherein the temperature variation amount per unit time is a difference between a current temperature detected by the temperature detection unit after the medium has passed the fixing member and a temperature detected after a prescribed period of time has elapsed.

9. The image forming apparatus according to claim 6, further comprising:

a temperature detection unit detecting temperature of the fixing member, wherein the control unit halts the rotation drive of the drive unit after a prescribed time period has elapsed, the prescribed time period being set according to the thickness of the medium in a case where a temperature variation amount per unit time becomes smaller than a prescribed temperature variation amount.

10. The image forming apparatus according to claim 9, wherein the prescribed time period is set longer in a case where the thickness of the medium is thick than in a case where the thickness of the medium is thin.

* * * * *